United States Patent [19]

Ikenoue et al.

[11] Patent Number: 5,071,736

[45] Date of Patent: Dec. 10, 1991

[54] SILVER HALIDE PHOTOGRAPHIC MATERIAL

[75] Inventors: Shinpei Ikenoue; Hisashi Okamura; Seimi Satake, all of Kanagawa, Japan

[73] Assignee: Fuji Photo Film Co., Ltd., Kanagawa, Japan

[21] Appl. No.: 652,730

[22] Filed: Feb. 8, 1991

Related U.S. Application Data

[63] Continuation of Ser. No. 414,507, Sep. 29, 1989, abandoned.

[30] Foreign Application Priority Data

Sep. 30, 1988 [JP] Japan ..... 63-246591

[51] Int. Cl.[5] ..... G03C 1/86

[52] U.S. Cl. ..... 430/533; 430/523; 430/539; 430/622

[58] Field of Search ..... 430/555, 622, 523, 539

[56] References Cited

U.S. PATENT DOCUMENTS

| | | | |
|---|---|---|---|
| 3,642,486 | 2/1972 | Burness et al. . | |
| 3,689,274 | 9/1972 | Sobel et al. | 430/622 |
| 3,868,257 | 2/1975 | Horii et al. . | |
| 4,137,082 | 1/1979 | Sera et al. | 430/622 |
| 4,187,113 | 2/1980 | Methews et al. | 430/533 |
| 4,241,170 | 12/1980 | Bayless . | |
| 4,401,787 | 8/1983 | Chen | 430/533 |
| 4,543,324 | 9/1985 | Himmelmann . | |
| 4,551,412 | 11/1985 | Ogawa et al. | 430/533 |
| 4,554,247 | 11/1985 | Yamashita et al. | 430/522 |
| 4,585,687 | 4/1986 | Posey et al. | 430/533 |
| 4,780,402 | 10/1988 | Remmington | 430/533 |
| 4,855,392 | 8/1988 | Chen | 430/533 |
| 4,859,570 | 8/1989 | Miller | 430/533 |
| 4,897,344 | 1/1990 | Okamura et al. | 430/533 |

FOREIGN PATENT DOCUMENTS

| | | |
|---|---|---|
| 49-24435 | 3/1974 | Japan . |

*Primary Examiner*—Jack P. Brammer

*Attorney, Agent, or Firm*—Sughrue, Mion, Zinn, Macpeak & Seas

[57] ABSTRACT

A silver halide photographic material comprising a film support having thereon at least one hydrophilic colloid layer, at least one of which is a photosensitive silver halide emulsion layer, wherein the film support is a polyester film having a water content of at last 0.5 wt %, and at least one gelatin-containing layer contains a vinylsulfone based film hardening agent.

14 Claims, No Drawings

SILVER HALIDE PHOTOGRAPHIC MATERIAL

This is a continuation of application Ser. No. 07/414,507 filed Sept. 29, 1989, now abandoned.

FIELD OF THE INVENTION

The present invention relates to a silver halide photographic material and is particularly directed to a silver halide photographic material comprising a polyester film support having a high water content, wherein at least one of the gelatin layers of the photographic material is hardened with a vinylsulfone based film hardening agent. The photographic material of the present invention has a rapid film hardening rate after manufacture, and excellent mechanical strength.

BACKGROUND OF THE INVENTION

Photographic materials are generally prepared by coating at least one photographic photosensitive layer on a plastic film support. A fiber based polymer as typified by triacetylcellulose (referred to hereinafter as "TAC") or a polyester based polymer as typified by poly(ethylene terephthalate) (referred to hereinafter as "PET") is generally used for the plastic film.

In the past, PET films have replaced TAC because of their excellent production properties, mechanical strength and dimensional stability. Even though PET films have the excellent properties indicated above, their use results in a low film hardening rate after manufacture, and lower productivity, such that the range of application is limited. On the other hand, the greatest advantages of TAC films as supports for photographic purposes include the lack of optical anisotropy and high transparency.

TAC films also have a further advantage in that the film hardens rapidly after manufacture.

There has been considerable diversification of the types and applications of photographic materials in recent years, and remarkable progress has been made with increased film transporting rates during photographing, increased magnification in photographing, and with the miniaturization of cameras. At the same time, there have been increased demands for supports for photographic materials having the properties of strength, dimensional stability and reduced film thickness, etc.

However, the properties of TAC are dictated by a rigid molecular structure, and films made from TAC are brittle and weak, such that TAC films cannot at the present time be used in these applications.

On the other hand, although PET films have excellent mechanical strength, they are disadvantageous in that the film hardening rate after manufacture is slow to the point of being impractical, and it is therefore desirable to solve this problem.

SUMMARY OF THE INVENTION

Hence, an objective of the present invention is to provide a photographic material comprising a support having superior transparency and mechanical properties and having a high film hardening rate after manufacture to thereby improve productivity.

The objective of the present invention has been realized by means of a silver halide photographic material comprising a polyester film support having thereon at least one hydrophilic colloid layer, at least one of which is a photosensitive silver halide emulsion layer, wherein the water content of the support is at least 0.5 wt%, and at least one gelatin containing layer contains a vinylsulfone based film hardening agent.

DETAILED DESCRIPTION OF THE INVENTION

The water content of the polyester film of the present invention is determined by equilibrating the film for 3 hours under conditions of 23° C., 30% RH, and then immersing the film in distilled water at 23° C. for 15 minutes. The water content is then measured using a micro-moisture meter (for example, a model CA-02 made by Mitsubishi Chemical Industries Ltd.) at a drying temperature of 150° C.

The water content of the polyester film of the present invention measured in this way is characteristically at least 0.5 wt%, and preferably within the range of from 0.6% to 4.0 wt%.

The improvement in the film hardening rate after manufacture is inadequate if the water content is less than 0.5 wt%, but if the water content is too high, the dimensional stability is adversely affected due to the uptake of moisture.

In the present invention, the polyester comprises an aromatic dibasic acid and a glycol as principal components. Typical dibasic acids include terephthalic acid and isophthalic acid, and examples of the glycols include ethylene glycol, propylene glycol, butanediol, neopentyl glycol, 1,4-cyclohexanediol and diethylene glycol. Among the polyesters made from such components, polyethylene terephthalate (PET) is the most suitable, since it is readily prepared.

As described herein, a poly(ethylene terephthalate) copolymer or PET composition is a copolyester comprising ethylene terephthalate units as a main component and units derived, for example, from aromatic dicarboxylic acids having a metal sulfonate group, aliphatic dicarboxylic acids and glycols, and segments derived from poly(alkylene glycols).

A copolymer poly(ethylene terephthalate) film preferably used in the present invention includes units derived from an aromatic dicarboxylic acid having a metal sulfonate group.

Examples of aromatic dicarboxylic acids having a metal sulfonate group include 5-sodiumsulfoisophthalic acid, 2-sodiumsulfoterephthalic acid, 4-sodiumsulfophthalic acid, 4-sodiumsulfo-2,6-naphthalenedicarboxylic acid and compounds in which the sodium is replaced by other metals, such as potassium or lithium. The proportion of the copolymer units derived from the aromatic dicarboxylic acid having a metal sulfonate group is preferably from 2 to 15 mol%, and most desirably from 4 to 10 mol%, with respect to the ethylene terephthalate units.

A PET composition including units derived from an aliphatic dicarboxylic acid having from 4 to 20 carbon atoms and/or one or more segments derived from a high molecular weight poly(alkylene glycol) is desirable from the point of view of transparency, especially with regard to suppression of the whitening of the copolymer film, and flex resistance.

Examples of the aliphatic dicarboxylic acid having from 4 to 20 carbon atoms include succinic acid, adipic acid and sebacic acid and, of these, the use of adipic acid is preferred. The proportion of the copolymer units derived from the aliphatic dicarboxylic acid having from 4 to 20 carbon atoms is preferably from 3 to 25 mol%, and most desirably from 5 to 20 mol%, with respect to the ethylene terephthalate units.

Poly(alkylene glycols) of average molecular weight of about 600 to 20,000 can be used as the high molecular weight poly(alkylene glycol). Poly(ethylene glycol) is especially desirable. The moisture permeability of the resulting film can be raised by including one or more poly(alkylene glycol) segments of molecular weight of about 600 to 20,000 in the polyester copolymer. The poly(alkylene glycol) segments can be included conjointly with units derived from the aliphatic dicarboxylic acid having from 4 to 20 carbon atoms as described above, or may be used alone. If used alone, the poly(alkylene glycol) segments must be included in an amount which does not impair the transparency or mechanical properties of the polyester film, and as a copolymer component, the poly(alkylene glycol) segments preferably account for less than 10 wt% of the resulting polyester.

Transparent polyester films of the present invention preferably have a haze measured in accordance with ASTM-D1003-52 of not more than 3%.

The thickness of the polyester film for use in the present invention is preferably at least 30 μm, but not more than 120 μm. A thickness of more than 30 μm but less than 100 μm is preferred for improving pressure sensitization or desensitization and pressure fogging when the photosensitive material is folded, and a film thickness of at least 30 μm but not more than 80 μm is most desirable.

Moreover, the polyester film having a water content of at least 0.5 wt% of the present invention is characterized by having superior curl eliminating properties (referred to hereinafter as the curl recovery factor) after development processing. That is to say, polyester films having a low water content have excellent mechanical strength but a low curl restoration factor, while the polyester film of the present invention is excellent in both of these respects, and this is especially desirable in the case of roll films. Typical roll films include films of 35 mm width or less used in cassette or cartridge form. Films having a curl recovery factor measured in accordance with the method described below of preferably at least 50%, and most desirably at least 80%, are preferred for roll film supports.

Measurement of the Curl Recovery Factor

A sample film of size 12 cm×35 mm is wound on a core of a diameter of 10 mm and maintained under conditions of 60° C., 30% RH for a period of 72 hours, after which the film is then removed from the core and immersed in distilled water at 40° C. for 15 minutes and then dried in a constant temperature air chamber at 55° C. with a load of 50 grams. Afterwards the sample is suspended vertically, the overall length is measured, and the extent to which the sample has recovered to its original sample length of 12 cm is assessed.

Moreover, various additives may be included in the poly(ethylene terephthalate) copolymer films of the present invention. For example, edge fogging which arises as a result of the high refractive index of the support is a problem when polyester films are used as supports for photographic materials. Triacetylcellulose (TAC) and polyesters such as poly(ethylene terephthalate) (PET) are generally used as supports for photographic purposes, and the refractive index is one of the major differences between the optical properties of TAC and PET. Thus, the refractive index of PET is about 1.6 while that of TAC is lower at 1.5. On the other hand, the refractive index of the gelatin which is normally used in the under-layer and photographic emulsion layers is from 1.50 to 1.55 and the ratio of the refractive index of gelatin to the film support is less than 1 (about 1.5/1.5) in the case of PET. Thus when light falls on the film edge, it tends to be reflected at the interface between the base and the emulsion layer. Hence, the so-called light piping phenomenon (edge fogging) occurs with polyester based films.

Methods of avoiding such light piping include the inclusion of inert inorganic particles in the film and the addition of dyes. The preferred method of preventing light piping in the present invention involves the addition of dyes which do not markedly increase the level of film haze.

No particular limitation is imposed upon the dyes which are used to dye the film, but those of a hue which provide the photosensitive material in general with an essentially gray coloration, and those which have excellent heat resistance in the temperature range used to manufacture the polyester films and which have excellent compatibility with polyesters, are preferred.

Dyes which satisfy these requirements can be prepared by mixing, for example, commercial dyes for polyesters such as "Diaresin" made by Mitsubishi Chemical Industries Ltd. and "Kayaset" made by NIPPON KAYAKU CO., LTD.

The dye concentration must be such that the color density in the visible region measured with a color densitometer made by the Macbeth Co. is not less than 0.01. Moreover, a color density of not less than 0.03 is preferred.

The polyester film of the present invention can be provided with easy-slip properties as needed. No particular limitation is imposed upon the means of providing the easy-slip properties, but methods such as the incorporation of inert inorganic compounds or coating with surfactants may be used.

Examples of such inert inorganic compounds include $SiO_2$, $TiO_2$, $BaSO_4$, $CaCO_3$, talc and kaolin. Methods in which easy-slip properties are obtained by means of external particles wherein inert particles are added to the above described polyester synthesis reaction systems, can be used. Furthermore, methods in which easy-slip properties are provided by means of an internal particle system, for example, wherein an added catalyst is precipitated out during the polymerization of the polyester, can also be used.

Since transparency is an important requirement of supports for photographic materials, an external particle system wherein $SiO_2$ having a refractive index close to that of the polyester film is used or an internal particle system in which the size of the precipitated particles is comparatively small, is preferred for imparting easy-slip properties.

Moreover, where easy-slip properties are to be imparted by incorporating, methods in which a layer which imparts these properties is provided by lamination are preferred for obtaining more transparent films. Such devices, in practical terms, include methods of co-extrusion using multiple extruders and a feed block, or a multi-manifold die.

In the present invention, the precipitation of lower molecular weight polymers during heat treatment while establishing the under-layer can be a problem depending on the copolymer ratio, but it is possible to laminate a normal polyester layer on at least one side of the support, and this can be achieved effectively using co-extrusion.

Synthesis of the raw material polymer for the copolymer poly(ethylene terephthalate) film of the present invention is achieved using known methods for preparing polyesters. For example, the synthesis can be achieved via a direct esterification reaction of the acid component with the glycol component, or in cases where a dialkyl ester is used for the acid component, an ester exchange reaction with the glycol component can be used and a copolymer poly(ethylene terephthalate) can be obtained by heating under reduced pressure and removing the excess glycol. Ester exchange reaction catalysts or polymerization reaction catalysts can be used, as required, at this point in the synthesis and thermal stabilizers can also be added.

The copolymer poly(ethylene terephthalate) obtained as described above is generally molded into granules and dried, and then it is melt extruded to form a non-extended sheet, after which the required film is obtained by means of biaxial extension and heat treatment.

The biaxial extension may be carried out with successive extensions in the longitudinal and transverse directions, or by simultaneous biaxial extension. No particular limit is imposed upon the stretching factor, but an extension of from 2.0 to 5.0 times is appropriate. Moreover, re-extension in the longitudinal or transverse direction can be carried out after longitudinal and transverse extensions.

The drying prior to melt extrusion is preferably carried out using a vacuum drying method or a demoisturizing drying method in the present invention.

The temperature during extension in the present invention is preferably from 70° to 100° C. for longitudinal extension and from 80° to 160° C. for transverse extension.

The thermal fixing temperature is from 150° to 210° C., and preferably 160° to 200° C.

With the copolymer compositions of this invention, the excellent transparency and mechanical strength of conventional PET are maintained; the film haze is less than 3%, the breaking strength is 8 to 25 kg/mm$^2$, the initial elasticity is from 200 to 500 kg/mm$^2$ and the tear strength at a film thickness of 120 μm is not less than 30 grams. With lower strengths, the excellent mechanical properties of conventional PET films are lost, and the advantage over TAC disappears.

The transparency, breaking strength, initial elasticity and the tear strength are measured in the manner indicated below.

Transparency

The film haze is measured in accordance with the method of ASTM-D1003-52.

Breaking Strength and Initial Elasticity

The breaking strength and initial elasticity are measured in accordance with the methods of JIS-Z1702-1976 using samples of width 10 mm and length 100 mm at a tensioning rate of 300 mm/minute in the case of breaking strength measurements, and 20 mm/minute in the case of initial elasticity measurements.

Measurement of Tear Strength

The value indicated when a remaining 51 mm has been torn using a light load type tear strength testing machine (made by Toyo Seiki Co.) with a sample size of 51×64 mm in which a 13 mm notch has been cut is taken as the measurement of tear strength.

The polyester film of the present invention can be subjected, as required, to a surface pre-treatment, such as a coronal discharge treatment, chemical treatment or a flame treatment, for example, in order to improve adhesion and the wetting properties of the coating solutions. Of these treatments, the coronal discharge treatment with which there is little precipitation of low molecular weight compounds on the film surface is preferred in the present invention.

The polyester support of the present invention preferably has an under-layer for increasing the strength of adhesion with the photographic layers, such as the photosensitive layers, which are provided thereon by coating.

Under-layers include those in which a polymer latex consisting of a styrene/butadiene based copolymer or vinylidene chloride based copolymer are used, and those in which a hydrophilic binder such as gelatin are used.

The use of an under-layer comprising a hydrophilic binder is preferred in the present invention.

Hydrophilic binders for use in the present invention include those disclosed in *Research Disclosure* 17643, page 26 and *Research Disclosure* 18716, page 651, and include water soluble polymers, cellulose esters, latex polymers and water soluble polyesters. Examples of the water soluble polymers include gelatin, gelatin derivatives, casein, agar, sodium alginate, starch, poly(vinyl alcohol), acrylic acid copolymers and maleic anhydride copolymers; examples of cellulose esters include carboxymethylcellulose, and hydroxyethylcellulose; and examples of the latex polymers include vinyl chloride-containing copolymers, vinylidene chloride-containing copolymers, acrylic acid ester-containing copolymers, vinyl acetate-containing copolymers and butadiene-containing copolymers. Of these materials, the use of gelatin is preferred.

Compounds which swell the support to increase the adhesion between the under-layer and the support can be used in the present invention, and examples include, resorcinol, chlororesorcinol, methylresorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate. Of these compounds, the use of resorcinol and p-chlorophenol is preferred.

Fine inorganic pigments such as $SiO_2$ and $TiO_2$, or fine poly(methyl methacrylate) copolymer particles (1 to 10 μm) can be included as matting agents in the under layers for use in the present invention.

The under-layers of the present invention can be coated using any of the generally well known coating methods, for example, by dip coating, air knife coating, curtain coating, wire bar coating, gravure coating or extrusion coating methods.

The photosensitive material of the present invention may have non-photosensitive layers, such as anti-halation layers, intermediate layers, backing layers, and surface protecting layers, for example, in addition to the photosensitive layers.

Hydrophobic polymers can be used as the binders for the backing layers, or the above noted hydrophilic polymers for use in the under-layers can also be used as the binders for the backing layers.

Anti-static agents, easy-slip agents, matting agents, surfactants and dyes, for example, can be included in the backing layers of photosensitive material of the present invention. No particular limitation is imposed upon the anti-static agents used in the backing layers, and polymers containing carboxylic acids, carboxylic acid salts and sulfonic acid salts, such as the polymers disclc ed, for example, in JP-A No. 48-22017, JP-B No. 46 24 ?, JP-A No. 51-30725, JP-A No. 51-129216 and JP-A No. 55-95942 can be used as anionic polymeric electrolytes. (The terms "JP-A" and "JP-B" used herein signify "unexamined published Japanese patent application" and "examined Japanese patent publication", respectively.) Examples of useful cationic polymers are disclosed, for example, in JP-A No. 49-121523, JP-A No. 48-91165 and JP-B No. 49-24582. Furthermore, ionic surfactants, both anionic and cationic, can be used, and examples of such compounds are disclosed, for example, in JP-A No. 49-85826, JP A No. 49-33630, U.S. Pat. Nos. 2,992,108 and 3,206,312, JP-A No. 48-87826, JP-B No. 49-11567, JP-B No. 49-11568 and JP-A No. 55-70837.

The use of at least one type of crystalline metal oxide selected from among ZnO, $TiO_2$, $SnO_2$, $Al_2O_3$, $In_2O_3$, $SiO_2$, MgO, BaO and $MoO_3$, or complex oxides thereof, is most desirable for the backing layer anti-static agent of the present invention.

The fine particles of crystalline metal oxide or complex oxide for use in the present invention have a volume resistivity of not more than $10^7$ Ω·cm, and preferably not more than $10^5$ Ω·cm. Moreover the particle size is from 0.01 to 0.7 μm, and preferably from 0.02 to 0.5 μm.

The fine electrically conductive crystalline metal oxides or complex oxides particles for use in the present invention can be prepared using the methods described in JP A No. 56-143430 and JP-A No. 60-258541. These materials are readily prepared using firstly the methods in which fine metal oxide particles are obtained by burning, and wherein a heat treatment is then carried out in the presence of metallic elements different from those comprising the metal oxide to thereby increase the electrical conductivity; secondly the methods in which metallic elements different from those comprising the metal oxide to thereby increase the electrical conductivity are present during the manufacture of the fine metal oxide particle by burning; and thirdly the methods in which the oxygen concentration in the atmosphere is reduced during the manufacture of the fine metal oxide particles by burning to thereby introduce oxygen defects. Examples of composition comprising a metal oxide and metallic elements different from those comprising the metal oxide include those in which Al or In, for example, is included in ZnO, those in which Nb or Ta, for example, is included in $TiO_2$, and those in which, Sb, Nb or halogen atoms are included in $SnO_2$. The amount of the different metallic element added is preferably within the rage from 0.01 to 30 mol%, most desirably within the range from 0.1 to 10 mol%, based on the amount of the fine metal oxide or complex oxide particles.

Th vinylsulfone based hardening agent for use in the present invention are represented by formula (I) indicated below:

$$X^1\text{-}SO_2\text{-}L\text{-}SO_2\text{-}X^2 \qquad (I)$$

wherein $X^1$ and $X^2$ represent $-CH{=}CH_2$ or $-CH_2CH_2$-Y groups, and $X^1$ and $X^2$ may be the same or different; Y represents a group which can be substituted by a nucleophilic reagent having a nucleophilic group, or a group which can be eliminated in the form of HY by means of a base; and L is a divalent linking group which may be substituted.

The film hardening agent of the present invention represented by formula (I) is described in detail below. Therein, $X^1$ and $X^2$ represent $-CH{=}CH_2$ or $-CH_2CH_2$-Y groups, wherein Y is a group which is substituted or eliminated by the action of a nucleophilic reagent or a base such as those having an amino group or a hydroxy group, and preferred examples of the groups $X^1$ and $X^2$ are indicated below.

$-CH{=}CH_2$, $-CH_2CH_2-Cl$ $-CH_2CH_2-Br$, $-CH_2CH_2-OSO_2CH_3$ $-CH_2CH_2-OSO_2C_6H_5$, $-CH_2CH_2-OSO_2C_6H_4-CH_3$ $-CH_2CH_2-OSO_3Na$, $-CH_2CH_2-OSO_3K$ $-CH_2CH_2-OCOCH_3$, $-CH_2CH_2-OCOCF_3$ $-CH_2CH_2-OCOCHCl_2$

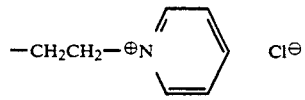

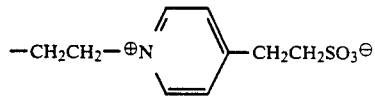

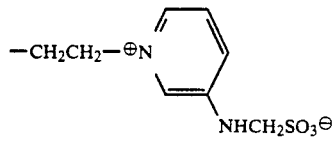

Particularly preferred examples of the groups $X^1$ and $X^2$ are indicated below.

$-CH{=}CH_2$, $-CH_2CH_2-Cl$ $-CH_2CH_2-Br$, $-CH_2CH_2-OSO_2CH_3$ $-CH_2CH_2-OSO_3Na$, $-CH_2CH_2-OSO_3K$

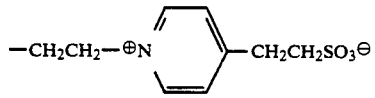

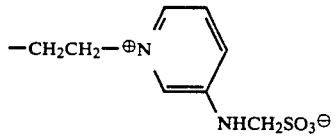

Moreover, the $-CH{=}CH_2$ group is the most desirable.

The divalent linking group L is a divalent group having up to 30 carbon atoms, preferably up to 10 carbon atoms, and comprising an alkylene group (including cycloalkylene groups), an arylene group (including heterocyclic aromatic groups such as 5- to 7-membered ring groups containing 1 to 3 hetero atoms (e.g., a divalent group derived from thiadiazole or pyridine)) or combinations of these groups with one or more units represented by -O-, $-NR^1-$, $-SO_2-$, $-SO_3-$, -S-, -SO , $-SO_2NR^1-$, -CO-, -COO-, $-CONR^1-$, $-NR^1COO-$ and $-NR^1CONR^1-$. Here, $R^1$ represents hydrogen or an alkyl group having from 1 to 15 carbon atoms, an aryl group or an aralkyl group. The $R^1$ groups may be joined together to form ring structures when the linking group includes two or more units of $-NR^1-$, $-SO_2NR^1-$ , $-CONR^1-$, $-NR^1COO-$ and $-NR^1CONR^1-$. Moreover, L may also be substituted by, for example, hydroxyl groups, alkoxy groups, carbamoyl groups, sulfamoyl group, sulfo groups or salts thereof, carboxyl groups or salts thereof, halogen atoms, alkyl groups, aralkyl groups and aryl groups. Furthermore, the substituent groups may be further substituted with one or more groups represented by $X^3-SO_2-$. Here, $X^3$ has the same significance as $X^1$ and $X^2$ described above.

The groups indicated below are typical examples of the linking group L. In these examples, a–k are integers of from 1 to 6. Of these, e can also have a value of zero, but e is preferably 2 or 3. The values of a–k except e are preferably 1 or 2, and most desirably are 1. In these formulae, $R^1$ preferably represents a hydrogen atom or an alkyl group having from 1 to 6 carbon atoms, and most desirably represents a hydrogen atom, a methyl group or an ethyl group.

$-(CH_2)_a-$ $-(CH_2)_b-O-(CH_2)_c-$ $-(CH_2)_d-CONR^1-(CH_2)_e-NR^1CO-(CH_2)_f-$ $-(CH_2)_g-SO_2-(CH_2)_h-$

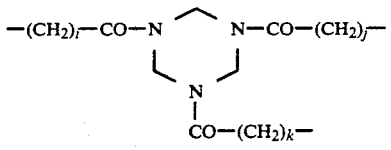

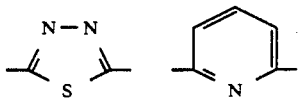

Typical nonlimiting examples of the film hardening agents for use in the present invention are indicated below.

H-1: $CH_2=CHSO_2CH_2SO_2CH=CH_2$

H-2: $CH_2=CHSO_2CH_2OCH_2SO_2CH=CH_2$

H-3: $CH_2=CHSO_2CH_2CH_2CH_2SO_2CH=CH_2$

H-4: $CH_2=CHSO_2CH_2CH(OH)CH_2SO_2CH=CH_2$

H-5: $CH_2=CHSO_2CH_2CONHCH_2CH_2NHCOCH_2SO_2CH=CH_2$

H-6: $CH_2=CHSO_2CH_2CONHCH_2CH_2CH_2NHCOCH_2SO_2CH=CH_2$

H-7

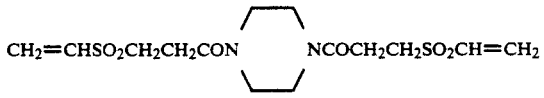

H-8

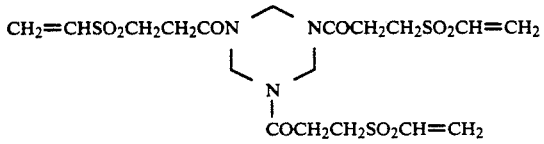

H-9

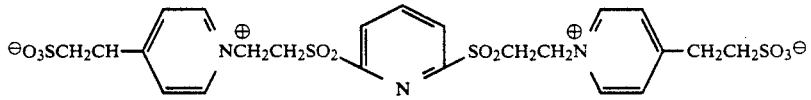

H-10

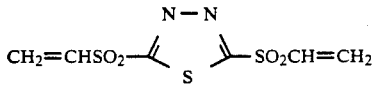

H-11: $(CH_2=CHSO_2CH_2)_3CCH_2SO_2CH_2CH_2NHCH_2CH_2SO_3Na$

H-12: $(CH_2=CHSO_2)_2CHCH_2CH_2-C_6H_4-SO_3Na$

The film hardening agents for use in the present invention may be prepared by the methods disclosed, for example, in U.S. Pat. Nos. 3,642,486, 3,865,257, 4,137,082 and 4,543,324, and JP-A No. 49-24435.

The total amount of film hardening agent added to the photographic material of the present invention is from 0.01 to 20 wt%, and preferably within the range of from 0.1 to 10 wt%, with respect to the total amount of gelatin, on a dry basis, present in the photographic material.

In the present invention, the film hardening agent can be pre added to the coating solution, or may be mixed with the coating solution immediately prior to coating.

The film hardening agents for use in the present invention can be used individually, or in combination thereof. Furthermore, the film hardening agents of the present invention may also be used in conjunction with other film hardening agents.

Examples of other film hardening agents for conjointly with the film hardening agents of the present invention include the aldehyde based compounds such as formaldehyde and glutaraldehyde; compounds having reactive halogen as disclosed, for example, in U.S. Pat. No. 3,288,775; the aziridine compounds disclosed, for example, in U.S. Pat. No. 3,017,280; the epoxy based compounds disclosed, for example, in U.S. Pat. No. 3,091,537; halocarboxyaldehydes such as mucochloric acid; dioxanes such as dihydroxydioxane and dichlorodioxane; and inorganic film hardening agents such as chromium alum and zirconium sulfate, for example.

Additional film hardening agents for conjoint use with the film hardening agents of the present invention are described below.

Known film hardening agents which, in the case of gelatin, provide a rapid hardening reaction and result in little post-hardening include the compounds having a dihydroquinoline structure as disclosed in JP-A No. 50-38540, the compounds having a phosphorus - halogen bond as disclosed in JP-A No. 58-113929, the compounds having an N-sulfonyloxyimido group as disclosed in JP-A No. 52-93470, and the compounds having at least two N-acyloxyimino groups within the same molecule as disclosed in JP-B No. 53-22089, the N-carbamoylpyridinium salts disclosed in JP-B Nos. 56-12853 and 58-32699, and the 2-sulfonyloxypyridinium salts disclosed in JP-A No. 56-110762.

The carboxyimides as disclosed, for example, in U.S. Pat. Nos. 2,938,892 and 3,098,693, the dihydroquinoline compounds disclosed in German Patent Application (OLS) No. 2,322,317, the carbamoylpyridinium compounds disclosed in German Patent Application (OLS) Nos. 2,225,230, 2,317,677 and 2,439,551, and the amidinium salt compounds disclosed in JP-A No. 60-225148 may also be used conjointly with the film hardening agents of the present invention.

Compounds which accelerate the film hardening reaction of gelatin can also be used conjointly with the film hardening agents of the present invention. For example, the conjoint use of the polymers containing the sulfinic acid groups disclosed in JP-A No. 56-4141 as film hardening accelerators with the film hardening agent of this invention is effective.

The vinylsulfone film hardening agent content of the present invention is preferably at least 50 mol% of the total amount of film hardening agent employed.

The film hardening rate varies depending on the storage conditions of the silver halide photographic material after coating, and a temperature is preferably within the range from 15° C. to 45° C. and more preferably from 30° C. to 40° C. The moisture content of the photosensitive material is preferably adjusted to provide the equilibrium water content at a relative humidity 50%–80% and more preferably 60%–75%.

The film hardening rate is undesirably slow if the temperature and the water content of the photosensitive material are too low. On the other hand, if the temperature and water content are too high, this results in an adverse effect on photographic performance, and is also undesirable.

No particular limitation is imposed upon the photographic layers in which the vinyl sulfone hardening agent of the present invention is incorporated and the vinyl sulfone hardening agent can be used in any gelatin containing layer, including non-photosensitive layers, such as under-layers, backing layers, filter layers, intermediate layers and protective layers, as well as in silver halide emulsion layers.

The gelatin for use with the hardening agents of the present invention may be lime treated gelatin wherein the raw material has been immersed in an alkali solution prior to gelatin extraction during the manufacturing process, acid treated gelatin wherein immersion in an acid bath has been carried out, double immersed gelatin wherein both of the above treatments have been carried out, or enzyme treated gelatin. Moreover, the film hardening agents can be used with low molecular weight gelatins wherein these gelatin has been heated in a water bath, or partially hydrolyzed by the action of proteolytic enzymes.

The gelatin for use with the film hardening agents of the present invention may be gelatin derivatives wherein a part of the gelatin has been replaced as required, by colloidal albumin, casein, a cellulose derivative such as carboxymethylcellulose or hydroxyethylcellulose, agar, sodium alginate, starch derivatives sugar derivatives such as dextran, synthetic hydrophilic colloids such as, for example, poly(vinyl alcohol), poly(N-vinylpyrrolidone), acrylic acid copolymers, polyacrylamide or derivatives and partial hydrolyzates of these substances.

When the film hardening agents of this invention are used in a photographic photosensitive material, synthetic polymeric compounds, such as latex type aqueous dispersions of vinyl compound polymers, and especially compounds which increase the dimensional stability of the photographic material, can used individually or in combination in the photographic emulsion layers and other layers, or combinations of these synthetic polymeric compounds with hydrophilic water permeable colloids may be included.

The photosensitive materials of the present invention may be either a black-and-white photosensitive material or a color photosensitive material, and the present invention is hereafter explained with respect to a color photosensitive material which is a preferred embodiment of the present invention.

The photosensitive materials of the present invention comprises a support having thereon at least one blue sensitive, one green sensitive and one red sensitive silver halide emulsion layer, but no particular limitation is imposed on the number of silver halide emulsion layers and non-photosensitive layers, or on the order in which the layers are established. A typical example includes silver halide photographic materials comprising a support, having thereon at least one photosensitive layer comprised of a plurality of silver halide emulsion layers having essentially the same color sensitivity but different photosensitivities, the said photosensitive layer being a unit photo-sensitive layer which is sensitive to blue light, green light or red light, and in a multi-layer silver halide color photographic material, the arrangement of the unit photosensitive layers is generally, from the support side, a red sensitive layer, a green sensitive layer, and a blue sensitive layer. This order may be reversed in accordance with the intended purpose, and a layer order such that photosensitive layers are provided in layers of the different color sensitivity may be adopted.

As described above, various non-photosensitive layers such as intermediate layers may be established between the silver halide photosensitive layers or as the uppermost and lowermost layers.

Couplers and the DIR compounds, etc., as disclosed in JP-A Nos. 61-43748, 59-113438, 59-113440, 61-20037 and 61-20038, can be included in the said intermediate layers, and anti color mixing agents may also be included in the intermediate layers in the usual manner.

The plurality of silver halide emulsion layers which make up each unit photosensitive layer preferably consists of a double layer structure comprising a high speed emulsion layer and a low speed emulsion layer, as disclosed in West German Patent No. 1,121,470 or British Patent No. 923,045. Normally, it is preferable that the layers be arranged such that the lower speed layer is closer to the support. A non-photosensitive layer may be established between the silver halide emulsion layers. Furthermore, the low speed emulsion layer can be established on the side remote from the support, and the high speed emulsion layer may be established on the side close to the support as disclosed, for example, in JP-A Nos. 57-112751, 62-200350, 62-206541 and 62 206543.

In practical terms, the layers can be arranged, for example, in the order, from the side furthest from the support, of a low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore the layers can be arranged in the order, from the side furthest from the support, of a blue sensitive layer/GH/RH/GL/RL, as disclosed in JP-B No. 55-34932. Furthermore, the layers can be arranged in the order, from the side furthest from the support, of a blue sensitive layer/GL/RL/GH/RH, as disclosed in the specifications of JP-A Nos. 56-25738 and 62-63936.

Furthermore, as disclosed in JP-B No. 49-15495, a high speed silver halide emulsion layer can be arranged as the uppermost layer, a lower speed silver halide emulsion layer can be arranged as a middle layer and a silver halide emulsion layer of even lower speed than the middle layer can be established as a lower layer to provide a unit structure consisting of three layers having different speeds, and wherein the speed decreases towards the support. In the case of structures consisting of three layers having different speeds as described above, the layers can be arranged within unit layers of the same color sensitivity in the order, from the side furthest from the support, of a medium speed emulsion layer/high speed emulsion layer/low speed emulsion layer, as disclosed in JP-A No. 59-202464.

As described above, a variety of layer structures and arrangements can be selected according to the intended purpose of the photosensitive material.

The preferred silver halide for use in the photographic emulsion layers of the photosensitive material of the invention include silver iodobromide, silver iodochloride or silver iodochlorobromide containing not more than about 30 mol% of silver iodide. Most desirably, the silver halide is a silver iodochloride or a silver iodochlorobromide containing from about 2 mol% to about 25 mol% of silver iodide.

The silver halide grains of the photographic emulsions for use in the present invention may have a regular crystalline form, such as a cubic, octahedral or tetradecahedral form, or may have an irregular crystalline form such as a spherical or plate-like form, or may have crystal defects such as twinned crystal planes, or may have a complex form consisting of a combination of these crystalline forms.

The silver halide grain size may be very fine grains of not more than about 0.2 microns, or may be large grains such that the projected area diameter is as large as about 10 microns, and the emulsions may be poly-disperse or mono dispersion emulsions.

Silver halide photographic emulsions for use in the present invention can be prepared using the methods described, for example, in *Research Disclosure* (RD) No. 17643 (December 1978), pages 22–23, *I, Emulsion Preparation and Types, Research Disclosure* No. 18716 (November 1979), page 648; *Chemie et Physique Photographicue*, by P. Glafkides, published by Paul Montel, 1967; *Photographic Emulsion Chemistry*, by G.F. Duffin, published by Focal Press, 1966; and *Making and Coating Photographic Emulsions*, by V.L. Zelikman et al., published by Focal Press, 1964, etc.

The mono-disperse emulsion disclosed, for example, in U.S. Pat. Nos. 3,574,628 and 3,655,394, and British Patent No. 1,413,748 are preferred.

Furthermore, tabular grains having an aspect ratio of at least about 5 can also be used as the emulsion of the present invention. Tabular grains are readily prepared using the method described, for example, by Gutoff in *Photographic Science and Engineering*, Volume 14, p. 248–257 (1970), and in U.S. Pat. Nos. 4,434,226, 4,414,310, 4,433,048 and 4,439,520, and British Patent No. 2,112,157.

The crystal structure may be uniform, or the interior and exterior parts may have a heterogeneous halogen composition or the crystal structure may comprise a layered structure. Moreover, silver halides having different compositions may be joined with an epitaxial junction or they may be joined to compounds other than silver halides, such as silver thiocyanate or lead oxide for example.

Mixtures of grains of various crystalline form may also be used.

The silver halide emulsions for use in the present invention are normally subjected to physical ripening, chemical ripening and spectral sensitization. Additives for use in such processes are disclosed, for example, in *Research Disclosure* Nos. 17643 and 18716, and the locations of these items within the respective Research Disclosures are summarized in the table below.

Known photographically useful additives for use in the present invention are also disclosed in the two *Research Disclosures* mentioned above, and the locations of these items within the respective *Research Disclosures* are also shown in the table below.

| Type of Additives | RD 17643 | RD 18716 |
|---|---|---|
| 1. Chemical Sensitizers | Page 23 | Page 648, right column |
| 2. Speed Increasing Agents | — | As above |
| 3. Spectral Sensitizers Supersensitizers | Pages 23 to 24 | Page 648, right column to page 649, right column |
| 4. Whiteners | Page 24 | — |
| 5. Anti-foggants and Stabilizers | Pages 24 to 25 | Page 649, right column |
| 6. Light Absorbers, Filter Dyes, UV Absorbers | Pages 25 to 26 | Pages 649, right column to page 650, left column |
| 7. Anti-staining Agents | Page 25, right column | Page 650, left column to right column |
| 8. Dye Image Stabilizers | Page 25 | — |
| 9. Film Hardening Agents | Page 26 | Page 651, left column |
| 10. Binders | Page 26 | As above |
| 11. Pasticizers, Lubricants | Page 27 | Page 650, right column |
| 12. Coating Promotors, Surfactants | Pages 26 to 27 | As above |
| 13. Antistatic Agents | Page 27 | As above |

Furthermore, the compounds which react with and fix formaldehyde as disclosed in U.S. Pat. Nos. 4,411,987 and 4,435,503 are preferably added to the photosensitive material of the present invention in order to prevent any deterioration of photographic performance due to formaldehyde gas.

Various color couplers can be used in this invention, and examples thereof are disclosed in the patents disclosed in the aforementioned *Research Disclosure* (RD) No. 17643, VII C to G.

The color couplers disclosed, for example, in U.S. Pat. Nos. 3,933,501, 4,022,620, 4,326,024, 4,401,752 and 4,248,961, JP-B No. 58-10739, British Patent Nos. 1,425,020 and 1,476,760, U.S. Pat. Nos. 3,973,968, 4,314,023 and 4,511,649, and European Patent No. 249,473, are preferred as yellow couplers for use in the present invention.

The 5-pyrazolone and pyrazoloazole based compounds are preferred as magenta couplers, and those disclosed, for example, in U.S. Pat. Nos. 4,310,619 and 4,351,897, European Patent No. 73,636, U.S. Pat. Nos. 3,061,432 and 3,725,064, *Research Disclosure* No. 24220 (June 1984), JP-A No. 60-33552, *Research Disclosure* No. 24230 (June 1984), JP-A Nos. 60-43659, 61-72238, 60-35730, 55-118034, 60-185951, U.S. Pat. Nos. 4,500,630, 4,540,654 and 4,556,630, and WO (PCT) 88,04795 are especially desirable for use in the present invention.

Phenol and naphthol based couplers may be used as the cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) No. 3,329,729, European Patent Nos. 121,365A and 249,453A, U.S. Pat. Nos. 3,446,622, 4,333,999, 4,753,871, 4,451,559, 4,427,767, 4,690,889, 4,254,212 and 4,296,199, and JP-A No. 61-42658 are preferred for use in the present invention.

The colored couplers for correcting the unwanted absorptions of colored dyes as disclosed, for example, in *Research Disclosure* No. 17643 section VII-G, U.S. Pat. No. 4,163,670, JP-B No. 57-39413, U.S. Pat. Nos. 4,004,929 and 4,138,258, and British Patent No. 1,146,368, are preferred for use in the present invention.

The couplers, the corresponding colored dyes of which have a suitable degree of diffusibility as disclosed in U.S. Pat. No. 4,366,237, British Patent No. 2,125,570, European Patent No. 96,570 and West German Patent (OLS) No. 3,234,533 are preferred for use in the present invention.

Typical examples of polymerized dye forming couplers for use in the present invention are disclosed, for example, in U.S. Pat. Nos. 3,451,820, 4,080,211, 4,367,282, 4,409,320 and 4,576,910, and British Patent No. 2,102,173.

Couplers which release photographically useful residual groups on coupling are preferably used in the present invention. The DIR couplers which release development inhibitors as disclosed in the patents referred to in the aforementioned *Research Disclosure* No. 17643, section VII-F, JP-A Nos. 57-151944, 57-154234, 60-184248, 63-37346, and U.S. Pat. No. 4,248,962 are preferred.

The couplers disclosed in British Patent Nos. 2,097,140 and 2,131,188, JP-A Nos. 59-157638 and 59-170840 are preferred for use in the present invention as couplers which image-wise release nucleating agents or development accelerators during development.

Other couplers for use in the photosensitive material of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A Nos. 60-185950 and 62-24252, the couplers which release dyes to which color is restored after elimination as disclosed in European Patent No. 173,302A, the bleach accelerator releasing couplers disclosed, for example, in *Research Disclosure* Nos. 11449 and 24241, and JP-A No. 61-201247, the ligand releasing couplers disclosed, for example, in U.S. Pat. No. 4,553,477, and the couplers which release leuco dyes disclosed in JP-A No. 63-75747.

The couplers for use in the present invention can be introduced into the photosensitive material using various known methods of dispersion.

Examples of high boiling point solvents for use in oil-in-water dispersion methods are disclosed, for example, in U.S. Pat. No. 2,322,027.

Examples of high boiling point organic solvents have a boiling point of 175° C. or above at normal pressure for use in the oil-in-water dispersion method include phthalates (for example, dibutyl phthalate, dicyclohexyl phthalate, di-2-ethylhexyl phthalate, decyl phthalate, bis (2,4-di-tert-amylphenyl) phthalate, bis(2,4-di-tert-amylphenyl) isophthalate and bis(1,1-diethylpropyl)phthalate), esters of phosphoric acid or phosphonic acid (for example, triphenyl phosphate, tricresyl phosphate, 2-ethylhexyl diphenyl phosphate, tricyclohexyl phosphate, tri-2-ethylhexyl phosphate, tri-dodecyl phosphate, tributoxyethyl phosphate, trichloropropyl phosphate and di-2-ethylhexylphenyl phosphonate), benzoic acid esters (for example, 2-ethylhexyl benzoate, dodecyl benzoate and 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl) sebacate, dioctyl azelate, glycerol tributyrate, isostearyl lactate and trioctyl citrate), aniline derivatives (for example, N,N-dibutyl-2-butoxy-5-tert-octylaniline), and hydrocarbons (for example, paraffins, dodecylbenzene and di-isopropylnaphthalene). Organic solvents of boiling point above about 30° C., and preferably of above 50° C., but below about 160° C., can be used as auxiliary solvents, and typical examples of such solvents include ethyl acetate, butyl acetate, ethyl propionate, methyl ethyl ketone, cyclohexanone, 2-ethoxyethyl acetate and dimethylformamide.

The processes and effects of the latex dispersion method, and examples of latexes for loading, are disclosed, for example, in U.S. Pat. No. 4,199,363, and West German Patent Application (OLS) Nos. 2,541,274 and 2,541,230.

The present invention can be applied to various types of color photosensitive materials. Typical examples include color negative films for general and cinematographic purposes, color reversal films for slide and television purposes, color papers, color positive films and color reversal papers, etc.

The photosensitive materials of the present invention are such that the total film thickness of all of the hydrophilic colloid layers on the side of the support having the emulsion layers is not more than 20 μm, and the film swelling rate $T_{\frac{1}{2}}$ is preferably less than 30 seconds. The term "film thickness" as used herein signifies the film thickness measured after equilibration (2 days) under conditions of temperature 25° C., relative humidity 55%, and the film swelling rate $T_{178}$ can be measured using procedures well known in the art. For example, the film swelling rate can be measured using a swellometer of the type described by A. Green on pages 124–129 of *Photographic Science and Engineering*, volume 19, number 2, and $T_{\frac{1}{2}}$ is defined as the time taken to reach ½ of the saturated film thickness, taking 90% of the maximum swelled film thickness attained on processing for 3 minutes 15 seconds at 30° C. in color development bath as the saturated film thickness.

The film swelling rate $T_{\frac{1}{2}}$ can be adjusted by adding film hardening agents to the binder gelatin, or by changing the aging conditions of the coated layer. The swelling factor is preferably from 150 to 400%. The swelling factor can be calculated from the maximum swelled film thickness under the conditions described above using the expression [(Maximum swelled film thickness—Film thickness)/Film thickness]×100.

Color photographic materials of the present invention can be developed and processed using the methods disclosed on pages 28–29 of the aforementioned *Research Disclosure* No. 17643 and from left to right columns on page 615 of the aforementioned *Research Disclosure* No. 18716.

The color development baths used for the development processing of the photosensitive material of the present invention are preferably aqueous alkaline solutions containing primary aromatic amine based color developing agents as the principal components. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of the developing agents can be used conjointly, depending on the intended purpose.

The color development baths for processing the photosensitive material of the present invention generally contain, for example, pH buffers, such as alkali metal carbonates, borates or phosphates, and development inhibitors or anti-fogging agents, such as bromides, iodides, benzimidazoles, benzothiazoles or mercapto compounds. The color development baths may also contain, as required, various preservatives such as hydroxylamine, diethylhydroxylamine, sulfites, hydrazines, phenylsemicarbazides, triethanolamine, catechol sulfonic acids, triethylenediamine(1,4-diazabicyclo[2,2,2]octane); organic solvents such as ethylene glycol and diethylene glycol; development accelerators such as benzyl alcohol, poly(ethylene glycol), quaternary ammonium salts and amines; dye forming couplers, competitive couplers, fogging agents such as sodium borohydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, typical examples of which include ethylenediamine tetraacetic acid, nitrilo traicetic acid, diethylenetriamine pentaacetic acid, cyclohexanediamine tetraacetic acid, hydroxyethylimino diacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine di(o-hydroxyphenylacetic acid), and salts of these compounds.

Color development is carried out after a normal black-and-white development in the case of reversal processing. The known black-and-white developing agents, for example, dihydroxybenzenes such as hydroquinone, 3-pyrazolidones such as 1-phenyl-3-pyrazolidone, and aminophenols such as N-methyl-p-aminophenol, can be used either individually or in combination in the black-and-white development baths.

The pH of the above described color development baths and black-and-white development baths is generally within the range of from 9 to 12. Furthermore, the replenishment rate of these development baths depends on the color photographic material which is being processed, but is generally less than 3 liters per square meter of photosensitive material. By reducing the bromide ion concentration in the replenisher, it is possible to use a replenishment rate of less than 500 ml per square meter of the photosensitive material. The prevention of loss of liquid by evaporation, and the prevention of aerial oxidation, by minimizing the contact area with the air in the processing tank is desirable in cases where the replenishment rate has been reduced. The replenishment rate can be reduced further by using a means of suppressing the accumulation of bromide ion in the developer.

The color development processing time is normally set between 2 and 5 minutes, but is possible to arrange shorter processing times by using higher temperatures, higher pH levels, and higher concentrations of the color developing agent.

The photographic emulsion layers of the present invention are normally subjected to a bleaching process after color development. The bleaching process may be carried out at the same time as the fixing process (in a bleach-fix process) or may be carried out as a separate process. Moreover, a bleach-fix process can be carried out after a bleaching process in order to speed-up processing. Moreover, the processing may be carried out in two consecutive bleach-fix baths, or a fixing process can be carried out before carrying out a bleach-fix process, or a bleaching process can be carried out after a bleach-fix process, according to the intended purpose of the processing. Compounds of a multi-valent metal, such as iron(III), cobalt(III), chromium(VI) and copper(II), peracids, quinones and nitro compounds, for example, can be used as bleaching agents. Typical bleaching agents include ferricyanides; dichromates; organic complex salts of iron(III) or cobalt(III), for example, complex salts with aminopolycarboxylic acids, such as ethylenediamine tetraacetic acid, diethylenetriamine pentaacetic acid, cyclohexanediamine tetraacetic acid, methylimino diacetic acid, 1,3-diaminopropane tetraacetic acid and glycol ether diamine tetraacetic acid, or citric acid, tartaric acid, malic acid, etc.; persulfates; bromates; permanganates and nitrobenzenes. The use of the aminopolycarboxylic acid iron(III) complex salts, principally ethylenediamine tetraacetic acid iron(III) complex salts, and persulfates, from among these compounds is preferred from the point of view of both rapid processing and the prevention of environmental pollution. Moreover, the aminopolycarboxylic acid iron(III) complex salts are especially useful in both bleach baths and bleach-fix baths. The pH of a bleach or bleach-fix bath in which aminopolycarboxylic acid iron(III) complex salts are used is normally from 5.5 to 8, but processing can be speeded up by using a lower pH.

Bleach accelerators can be used, as required, in the bleach baths, bleach-fix baths, or bleach or bleach-fix pre-baths for processing the photosensitive material of the present invention. Examples of useful bleach accelerators include the compounds having a mercapto group or a disulfide group as disclosed, for example, in U.S. Pat. No. 3,893,858, West German Patent Nos. 1,290,812 and 2,059,988, JP-A Nos. 53-32736, 53-57831, 53-37418, 53-72623, 53-95630, 53-95631, 53-104232, 53-124424, 53-141623, 53-28426, and *Research Disclosure* No. 17129 (July 1978); the thiazolidine derivatives disclosed in JP-A No. 50-140129; the thiourea derivatives disclosed in JP-B No. 45-8506, JP-A Nos. 52-20832, 53-32735, and U.S. Pat. No. 3,706,561; the iodides disclosed in West German Patent No. 1,127,715 and JP-A No. 58-16235; the polyoxyethylene compounds disclosed in West German Patent Nos. 966,410 and 2,748,430; the polyamine compounds disclosed in JP-B No. 45-8836; the other bleach accelerators disclosed in JP-A Nos. 49-42434, 49-59644, 53-94927, 54-35727, 55-26506 and 58-163940; and bromide ions, etc. From among these compounds, those having a mercapto group or a disulfide group are preferred in view of their large accelerating effect, and the use of the compounds disclosed in U.S. Pat. No. 3,893,858, West German Patent No. 1,290,812 and JP-A No. 53-95630 is especially desirable. Moreover, the use of the compounds disclosed in U.S. Pat. No. 4,552,834 is also desirable. These bleach accelerators may also be added to the photosensitive material of the present invention. The bleach accelerators are especially effective when bleach-fixing camera color photosensitive materials.

Thiosulfates, thiocyanates, thioether based compounds, thioureas, and large quantities of iodides can be used, for example, as fixing agents for processing the photosensitive material of the present invention, but thiosulfates are generally used for this purpose and ammonium thiosulfate, in particular, can be used in the widest range of applications. Sulfites and bisulfites, or carbonylbisulfite addition compounds, are the preferred preservatives for the bleach-fix baths.

The silver halide color photographic material of the present invention is generally subjected to a water washing and/or stabilizing process after the desilvering process. The amount of water used in the water washing process can be set within a wide range according to the nature of the photosensitive material (for example, the content of the materials, such as the couplers), the wash water temperature, the number of washing tanks (the number of washing stages), the replenishment system, i.e. whether a counter-flow or a sequential-flow system is used, and various other conditions. The relationship between the amount of water used and the number of water washing tanks in a multi-stage counterflow system can be determined using the method outlined on pages 248–253 of *Journal of the Society of Motion Picture and Television Engineers*, Volume 64 (May 1955).

The usage amount of the wash water can be greatly reduced by employing the multi-stage counterflow system noted in the above described literature, but bacteria tend to proliferate due to the increased residence time of the water in the tanks. Problems also arise as a result of the sediments which are formed and become attached to the photosensitive material. The method wherein the calcium ion and manganese ion concentration is reduced as disclosed in JP-A No. 62-288838 can be used very effectively to overcome problems of this sort in the processing of color photosensitive material of the present invention. Furthermore, the isothiazolone compounds and thiabendazoles disclosed in JP-A No. 57-8542, and chlorine based disinfectants such as chlorinated sodium isocyanurate, and benzotriazoles, etc., and the disinfectants disclosed in *Chemistry of Biocides and Fungicides* by Horiguchi, Killing Microorganisms, Biocidal and Fungicidal Techniques, published by the Health and Hygiene Technical Society, and in *A Dictionary of Biocides and Fungicides*, published by the Japanese Biocide and Fungicide Society, can be used for this purpose.

The pH value of the wash water for use in processing the photosensitive material of the present invention is within the range of from 4 to 9, and preferably within the range of from 5 to 8. The wash water temperature and the washing time is set depending on the nature of the photosensitive material and the intended application, etc. but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive material of the present invention can be processed directly in a stabilizing bath instead of being subjected to a water wash as described above. The known methods disclosed in JP-A Nos. 57-8543, 58 14834 and 60-220345 can all be used for this purpose.

Furthermore, the stabilization process may be carried out following the aforementioned water washing process, and the stabilizing baths containing formaldehyde and a surfactant for use as a final bath for camera color photosensitive materials are an example of such a process. Various chelating agents and fungicides, etc. can be added to these stabilizing baths.

The overflow which accompanies replenishment of the above described wash water and/or stabilizer can be reused in other processes such as the desilvering process, etc.

A color developing agent may also be incorporated into the silver halide color photosensitive material of the present invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,500 and *Research Disclosure* Nos. 14850 and 15159, the aldol compounds disclosed in *Research Disclosure* No. 13924, the metal salt complexes disclosed in U.S. Pat. No. 3,719,492 and the urethane based compounds disclosed in JP-A No. 53-135628 can be used for this purpose.

Various 1-phenyl-3-pyrazolidones may be incorporated, as required, into the silver halide color photosensitive material of the present invention to accelerate color development. Typical compounds of this type have been disclosed, for example, in JP-A Nos. 56-64339, 57-144547 and 58-115438.

The various processing baths for use in processing the photosensitive material of the present invention are employed at a temperature of from 10° C. to 50° C. The standard temperature is normally from 33° C. to 38° C., but processing is accelerated and the processing time is shortened at higher temperatures and, conversely, increased image quality and improved stability of the processing baths can be achieved at lower temperatures. Furthermore, processes using hydrogen peroxide intensification or cobalt intensification as disclosed in West German Patent No. 2,226,770 or U.S. Pat. No. 3,674,499 can be carried out in order to economize on silver included in the photosensitive material of the present invention.

Furthermore, the silver halide photosensitive material of the present invention can also be used as a thermal development type photosensitive material as disclosed, for example, in U.S. Pat. No. 4,500,626, JP-A Nos. 60-133449, 59-218443, 61-238056, and European Patent No. 210,660A2.

The invention is described by means of the illustrative examples below, but the invention is not to be construed as being limited thereby. Unless otherwise indicated, all parts, percents, ratios and the base are by weight.

EXAMPLE 1

1) Preparation of Poly(ethylene terephthalate) Films with Increased Water Uptake Properties Calcium acetate (0.1 part by weight) and 0.03 part by weight of antimony trioxide were added to 100 parts of dimethyl terephthalate, 70 parts by weight of ethylene glycol, 10 parts by weight of dimethyl 5-sodiumsulfoisophthalate and 10 parts by weight of dimethyl adipate, and an ester exchange reaction was carried out by gradually heating and removing methanol produced. Next, 0.05 part by weight of trimethyl phosphate was added to the product thus obtained. The temperature was gradually increased, the pressure was reduced, and polymerization was carried out, ultimately, under conditions of 280° C. and 1 mmHg, and a copolymer poly(ethylene terephthalate) was obtained. The intrinsic viscosity of the copolymer poly(ethylene terephthalate) was 0.65 measured in o-chlorophenol at 25° C.

The copolymer poly(ethylene terephthalate) was dried at 130° C. for 5 hours, after which it was melt extruded at 280° C. and a non-extended sheet was prepared. Next, the sheet was extended sequentially by 3.5 times in the longitudinal direction at 90° C. and by 3.7 times in the transverse direction at 95° C., after which the film was thermally set for 5 seconds at 200° C. to provide a biaxially extended film having thickness 100 μm. The film had a haze of 1.2%, a breaking strength 12 kg/mm and an initial elasticity of 340 kg/mm, and the film had good transparency and mechanical properties.

The transparency, breaking strength and initial elasticity were measured under the conditions indicated below.

Transparency: Film haze measured in accordance with the method described in ASTM-D1003-52.

Breaking Strength and Initial Elasticity: The above parameters were measured in accordance with the methods described in JIS Z1702 - 1976 using samples of width 10 mm and length 100 mm at a tensioning rate of 300 mm/minute for the breaking strength measurements, and 20 mm/minute for the initial elasticity measurements.

2) Preparation of Photographic Materials 2-1) Coating of the Under-Layer

Both sides of the PET copolymer film of the present invention obtained as above and a commercial PET film were subjected to a corona discharge treatment, and under-layers having the composition as indicated below were coated on both sides of the support. The corona discharge treatment was carried out at 0.02 KVA·minute/$m^2$ Gelatin: 3 g
Distilled water: 250 cc
Sodium α-sulfodi-2-ethylhexylsuccinate: 0.05 g
Formaldehyde 0.02 g 2 2) Coating of the Backing Layer A backing layer having the composition as indicated below was coated onto one side (i.e., the back side) of the under-layered PET films.

Preparation of a Tin Oxide Antimony Oxide Complex Dispersion:

Hydrated stannic chloride (230 parts by weight) and 23 parts by weight of antimony trichloride were dissolved in 3000 parts by weight of ethanol to obtain a uniform solution. This solution was titrated with an aqueous 1N sodium hydroxide solution until the pH of the aforementioned solution reached 3, and a co-precipitate of colloidal stannic oxide and antimony oxide was obtained. This co-precipitate was stored at 50° C. for 24 hours to form a red-brown colloidal precipitate.

The red-brown colloidal precipitate was separated by centrifuging and then washed with water by adding water to the precipitate and centrifuging again in order to remove the excess solute. This operation was repeated three times until the excess solute was removed.

Two hundred parts by weight of the colloidal precipitate from which the excess solute had been removed was re-dispersed in 1500 parts by weight of water and sprayed into a baking oven which had been heated to 600° C. A fine particle powder of blue colored tin oxide—antimony oxide complex having an average particle size of 0.2 μm was obtained. The specific resistance of this fine particle powder was 25 Ω·cm.

Forty parts by weight of the above obtained fine particle powder and 60 parts by weight of water were mixed, the pH was adjusted to 7.0, after which the powder was crudely dispersed by means of an agitator and then re-dispersed in a transverse type sand mill (trade name "Dynomil", made by Willy A. Bachofen AG) employing a residence time of 30 minutes, to provide the fine electrically conductive particle dispersion.

Coating the Backing Layer:

The formula (A) indicated below wa coated on the backside of the film samples to provide a dry film thickness of 0.3 μm and which was dried for 30 seconds at 130° C. The protective layer coating solution (B) indicated below was then coated over the layer containing the formula (A) to provide a dry film thickness of 1.0 μm and which was dried for 2 minutes at 130° C.

Formula (A)

Fine electrically conductive 10 parts by weight particle dispersion:
Gelatin: 1 part by weight
Water: 27 parts by weight
Methanol: 60 parts by weight
Resorcinol: 2 parts by weight
Polyoxyethylenenonylphenyl: 0.01 part by weight ether:

Protective Layer Coating Solution (B)

Cellulose triacetate: 1 part by weight
Acetone: 70 parts by weight
Methanol: 15 parts by weight
Dichloromethane: 10 parts by weight
p-Chlorophenol: 4 parts by weight 2-3) Coating of the Photosensitive Layer Each of the layers having the compositions as indicated below were lamination coated onto the two types of support prepared in 2-1) above, to obtain Multi-layer Color Photosensitive Materials 1 and 2.

Photosensitive Layer Composition

The numerical value corresponding to each component indicates the coated weight expressed in units of g/m$^2$, and in the case of silver halides, the coated weight is shown as the calculated coated weight of silver. However, in the case of the sensitizing dyes, the coated weight is indicated in units of mols per mol of silver halide in the same layer.

First Layer: Anti halation Layer
Black colloidal silver: as silver 0.18
Gelatin: 0.40

Second Layer: Intermediate Layer
2,5-Di-tert-pentadecylhydroquinone: 0.18
EX-1: 0.07
EX-3: 0.02
EX-12: 0.002
U-1: 0.06
U-2: 0.08
U-3: 0.10
HBS-1: 0.10
HBS-2: 0.02
Gelatin: 1.04

Third Layer: First Red-Sensitive Emulsion Layer
Mono-disperse silver iodo- as silver 0.55 bromide emulsion (6 mol% AgI, average grain size 0.6 μm, variation coefficient of grain size 0.15)
Sensitizing Dye I: $6.9\times10^{-5}$
Sensitizing Dye II: $1.8\times10^{-5}$
Sensitizing Dye III: $3.1\times10^{-4}$
Sensitizing Dye IV: $4.0\times10^{-5}$
EX-2: 0.350
HBS-1: 0.005
EX-10: 0.020
Gelatin: 1.20

Fourth Layer: Second Red-Sensitive Emulsion Layer
Tabular silver iodobromide as silver 1.0 emulsion (10 mol% AgI, average grain size 0.7 μm, average aspect ratio 5.5, average thickness 0.02 μm)
Sensitizing Dye I: $5.1\times10^{-5}$
Sensitizing Dye II: $1.4\times10^{-5}$
Sensitizing Dye III: $2.3\times10^{-4}$
Sensitizing Dye IV: $3.0\times10^{-5}$
EX-2: 0.400
EX 3: 0.050
EX-10: 0.015
Gelatin: 1.30

Fifth Layer: Third Red-Sensitive Emulsion Layer
Silver iodobromide emulsion as silver 1.60 (16 mol% AgI, average 9rain size 1.1 μm).
Sensitizing Dye IX: $5.4\times10^{-5}$
Sensitizing Dye II: $1.4\times10^{-5}$
Sensitizing Dye III: $2.4\times10^{-4}$
Sensitizing Dye IV: $3.1\times10^{-5}$
EX-3: 0.240
EX-4: 0.120
HBS-1: 0.22
HBS-2: 0.10
Gelatin: 1 63

Sixth Layer: Intermediate Layer
EX-5: 0.040
HBS-1: 0.020
EX-12: 0.004
Gelatin: 0.80

Seventh Layer: First Green-Sensitive Emulsion Layer
Tabular silver iodobromide as silver 0.40 emulsion (6 mol% AgI, average grain size 0.6 μm, average aspect ratio 6.0, average thickness 0.15 μm):
Sensitizing Dye V: $3.0\times10^{-5}$
Sensitizing Dye VI: $1.0\times10^{-4}$
Sensitizing Dye VII: $3.8\times10^{-4}$
EX-6: 0.260
EX-1: 0.021
EX-7: 0.030
EX-8: 0.025
HBS-1: 0.100
HBS-4: 0.010
Gelatin: 0.75

Eighth Layer: Second Green-Sensitive Emulsion Layer
Mono-disperse silver iodo- as silver 0.80 bromide emulsion (9 mol% AgI, average grain size 0.7 μm, variation coefficient of grain size 0.18):
Sensitizing Dye V: $2.1\times10^{-5}$
Sensitizing Dye VI: $7.0\times10^{-5}$
Sensitizing Dye VII: $2.6\times10^{-4}$
EX-6: 0.180
EX-8: 0.010
EX-1: 0.008
EX-7: 0.012
HBS 1: 0.16
HBS-4: 0.008
Gelatin: 1.10

Ninth Layer: Third Green-Sensitive Emulsion Layer
Silver iodobromide emulsion as silver 1.20 (12 mol% AgI, average grain size 1.0 μm):
Sensitizing Dye V: $3.5\times10^{-5}$
Sensitizing Dye VI: $8.0\times10^{-5}$
Sensitizing Dye VII: $3.0\times10^{-4}$
EX-6: 0.065
EX-11: 0.030
EX-1: 0.025
HBS-1: 0.25
HBS-2: 0.10
Gelatin: 1.74

Tenth Layer: Yellow Filter Layer
Yellow colloidal silver: as silver 0.05
EX-5: 0.08
HBS-3: 0.03
Gelatin: 0.95

Eleventh Layer: First Blue-Sensitive Emulsion Layer
Tabular silver iodobromide as silver 0.24 emulsion (6 mol% AgI, average grain size 0.6 μm, average aspect ratio 5.7, average thickness 0.15 μm):
Sensitizing Dye VIII: $3.5\times10^{-4}$
EX-9: 0.85
EX-8: 0.12
HBS-1: 0.28
Gelatin: 1.28

Twelfth Layer: Second Blue-Sensitive Emulsion Layer
Mono-disperse silver iodo- as silver 0.45 bromide emulsion (10 mol% A9I, average grain size 0.8 μm, variation coefficient of grain size 0.16):
Sensitizing Dye VIII: $2.1\times10^{-4}$
EX 9: 0.20
EX-10: 0.015
HBS-1: 0.03
Gelatin: 0.46

Thirteenth Layer: Third Blue-Sensitive Emulsion Layer
Silver iodobromide emulsion as silver 0.77 (14 mol% AgI, average grain size 1.3 μm).
Sensitizing Dye VIII: $2.2\times10^{-4}$
EX-9: 0.20
HBS-1: 0.07
Gelatin: 0.69

Fourteenth Layer: First Protective Layer
Silver iodobromide emulsion as silver 0.5 (1 mol% AgI, average grain size 0.07 μm)
U-4: 0.11
U-5: 0.17
HBS-1: 0.90
Gelatin: 1.00

Fifteenth Layer: Second Protective Layer

Poly(methyl methacrylate) particles 0.54 (Average size about 1.5 μm):
S-1: 0.15
S-2: 0.05
Gelatin: 0.72

The film hardening agent H-5 was added in an amount of 2.5 wt% with respect to the total amount of gelatin coated. Surfactants were also added.

Photosensitive Materials 3 and 4 were prepared in the same way as Photosensitive Materials 1 and 2, except that the hardening agent H-A was used in an amount of 1.4 wt% with respect to the total amount of gelatin in place of the hardening agent H-5.

U-1

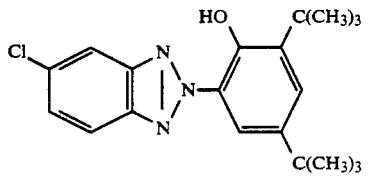

U-2

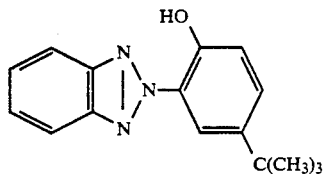

U-3

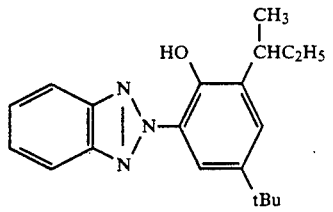

U-4

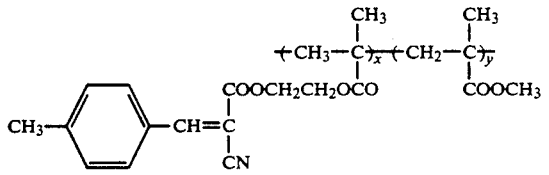

(x/y = 7/3 (by weight)

U-5

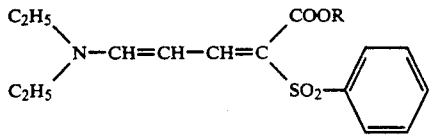

R = $C_8H_{17}$

EX-1

-continued
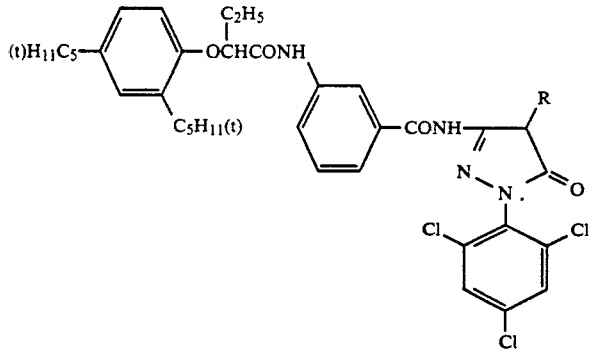
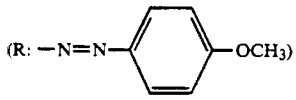
EX-2
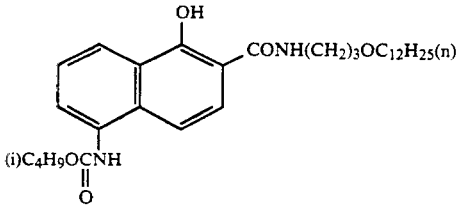
EX-3
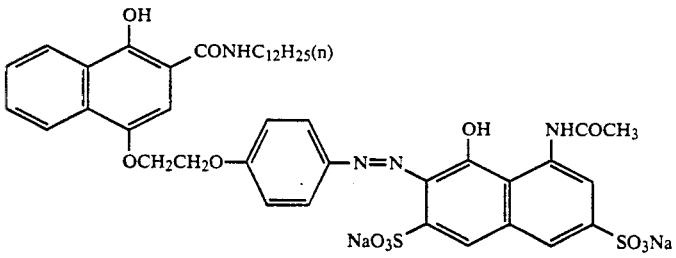
EX-4
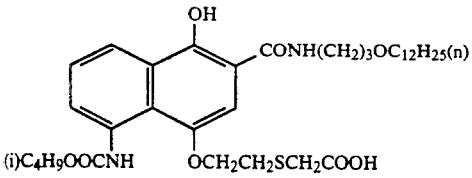
EX-5
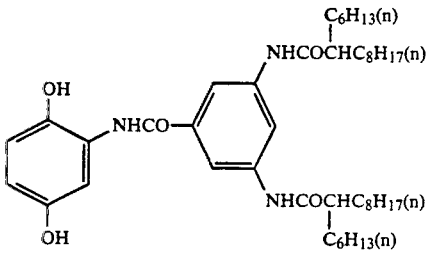
EX-6

-continued
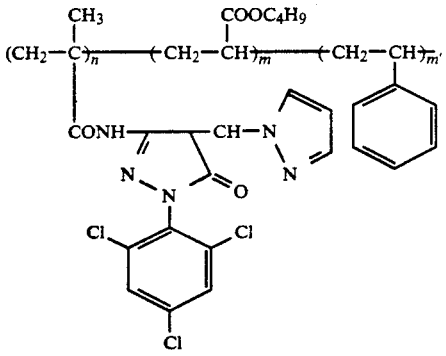
n = 50
m = 25
m' = 25
mol. wt about 30,000
EX-7
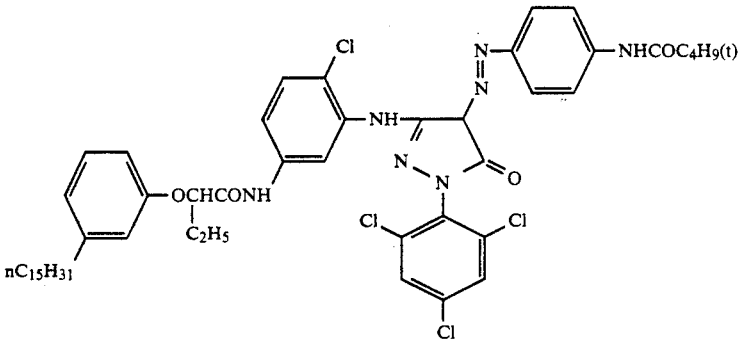
EX-8
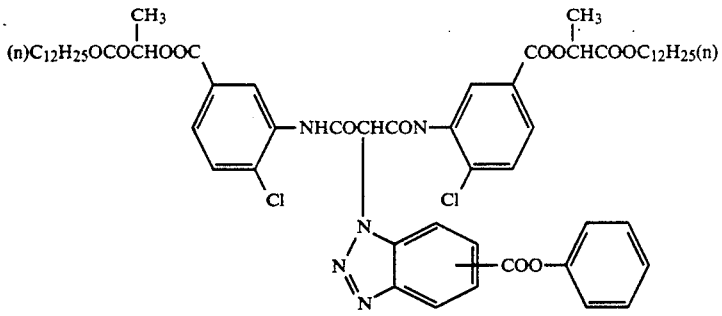
EX-9
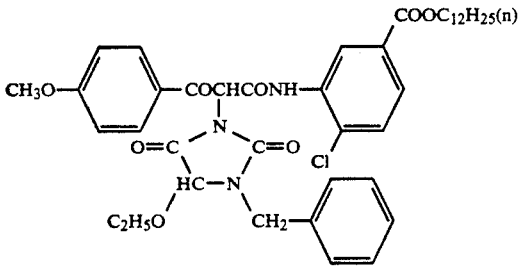
EX-10

-continued
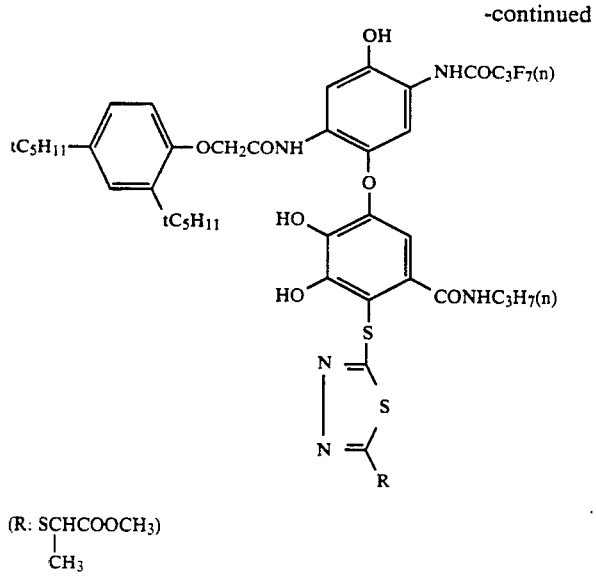
(R: SCHCOOCH3)
|
CH3
EX-11
Same as EX-1 except that R=H.
HBS-1: Tricresyl phosphate
HBS-2: Dibutyl phthalate
HBS-3: Bis(2-ethylhexyl)phthalate
EX-12
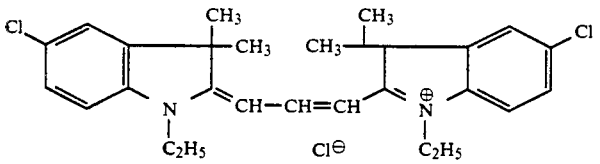
S-1
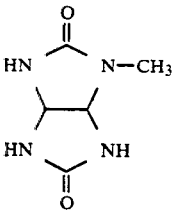
S-2
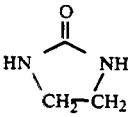
HBS-4
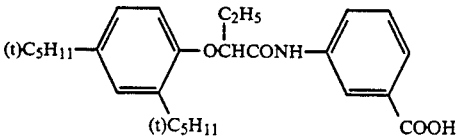
H-A -continued
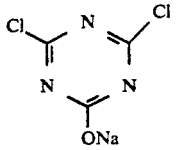
Sensitizing Dye I
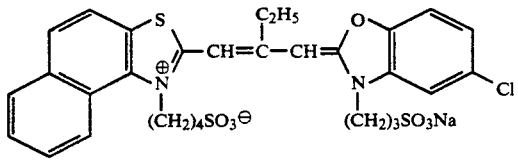
Sensitizing Dye II
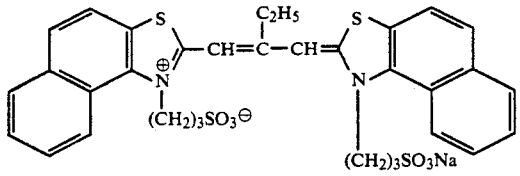
Sensitizing Dye III
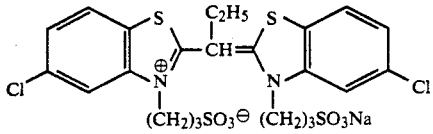
Sensitizing Dye IV
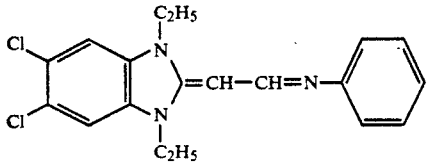
Sensitizing Dye V
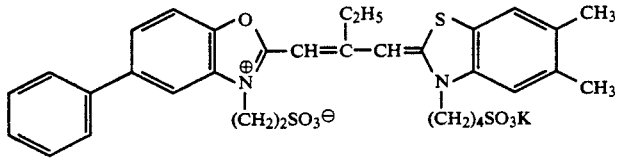
Sensitizing Dye VI
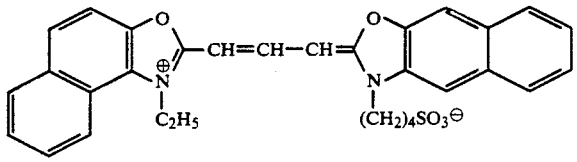
Sensitizing Dye VII -continued

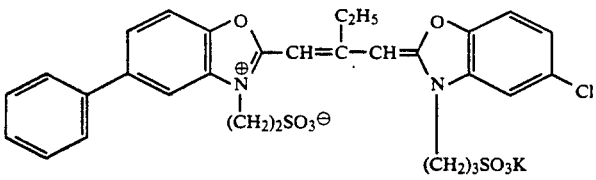

Sensitizing Dye VIII

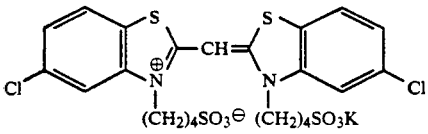

Sensitizing Dye IX

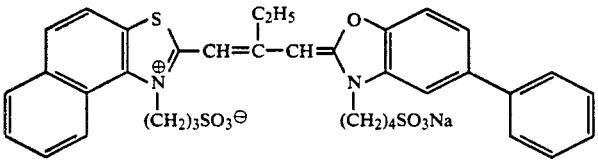

After coating Photosensitive Material 1 to 4, the moisture levels were adjusted in an environment of 25° C. and 70% RH in the final drying process.

Photosensitive materials 1 to 4 were stored at 25° C. in the rolled state and then subjected to photographic processings (light exposure using a light source of 4800° K.+development processings described below) and swelling test, respectively, and the number of days of the storage for the characteristic curve (as a measurement of photographic performance) and the degree of swelling with water (measured as described below}of the photosensitive material to reach constant values were determined. The results are shown in Table 1.

The development processing conditions were as indicated below.

| Processing Operation | Temperature | Time |
|---|---|---|
| Color Development | 38° C. | 3 minutes |
| Stop | 38° C. | 1 minute |
| Water Wash | 38° C. | 1 minute |
| Bleach | 38° C. | 2 minutes |
| Water Wash | 38° C. | 1 minute |
| Fix | 38° C. | 2 minutes |
| Water Wash | 38° C. | 1 minute |
| Stabilization Bath | 38° C. | 1 minute |

The compositions of the processing baths used were as indicated below.

Color Development Bath
- Sodium hydroxide: 2 g
- Sodium sulfite: 2 g
- Potassium bromide: 0.4 g
- Sodium Chloride: 1 g
- Borax: 4 g
- Hydroxylamine sulfate: 2 g
- Ethylenediamine tetraacetic acid di-sodium salt, dihydrate: 2 g
- 4-Amino-3-methyl-N-ethyl-N-(β-hydroxyethyl)aniline mono-sulfate: 4 g
- Water: to make up to a total of 1 liter Stop Bath
- Sodium thiosulfate: 10 g
- Ammonium thiosulfate aqueous solution (700 g/l): 30 ml
- Acetic acid: 30 ml
- Sodium acetate: 5 g
- $KAl(SO_4)_2 \cdot 12H_2O$: 15 g
- Water: to make up to a total of 1 liter Bleach Bath
- Ethylenediamine tetraacetic acid ferric sodium salt, dihydrate: 100 g
- Potassium bromide: 50 g
- Ammonium nitrate: 50 g
- Boric acid: 5 g
- Aqueous ammonia: to adjust to pH 5.0
- Water: to make up to a total of 1 liter Fixer Bath
- Sodium thiosulfate: 150 g
- Sodium sulfite: 15 g
- Borax: 12 g
- Glacial acetic acid: 15 ml
- $KAl(SO_4)_2 \cdot 12H_2O$: 20 g
- Water: to make up to a total of 1 liter Stabilizer Bath
- Boric acid: 5 g
- Sodium citrate: 5 g
- Sodium metaborate (tetra-hydrate): 3 g
- $KAl(SO_4)_2 \cdot 12H_2O$: 15 g
- Water: to make up to a total of 1 liter The state of curling after development processing was such that curl was not eliminated in the case of the photosensitive materials in which the commercial PET was used as a support, but there was virtually no curl at all in the case of the photosensitive materials made using a PET film of the present invention for the support.

The condition used to measure the swelling of the photosensitive layer were as indicated below.

The swelled film thickness was measured after immersion in water at 25° C. for a period of 3 minutes. The degree of swelling was calculated from the measured results using the following equation:

Degree of Swelling =

-continued $$\frac{\text{(Thickness increased by swelling)}}{\text{(Total thickness of dry film)} - \text{(Thickness of Support)}}$$

The water content of the support was determined using the method described above.

TABLE 1

| Photosensitive Material | Water Content of Support (%) | Film Hardening Agent | Time Required for Degree of Swelling to Become Constant (Days) | Time Required for Photographic Performance* to Become Constant (Days) |
|---|---|---|---|---|
| 1 (Invention) | 0.7 | H-5 | 8 | 10 |
| 2 (Comp. Ex.) | 0.4 | H-5 | 14 | 16 |
| 3 (Comp. Ex.) | 0.7 | H-A | 20 | 20 |
| 4 (Comp. Ex.) | 0.4 | H-A | 35 | 35 |

*The changes in color density of the blue-, green- and red-sensitive layer were measured at the exposure amount that the density becomes fog + 1.5 with respect to the red-sensitive layer.

It is clear from the above results that the samples of the present invention required less time to stabilize after coating.

EXAMPLE 2

Photosensitive Materials 5, 6, 7 and 8 were prepared in just the same way as Photosensitive Materials 1, 3, 2 and 4, respectively, except that an amount of 2 wt% with respect to total gelatin of H-1, and 2.8 wt% with respect to total gelatin of H-2 were used in place of the film hardening agent H-5.

Tests were carried out in the same way as in Example 1, and the results obtained are shown in Table 2.

TABLE 2

| Photosensitive Material | Water Content of Support (%) | Film Hardening Agent | Time Required for Degree of Swelling to Become Constant (Days) | Time Required for Photographic Performance to Become Constant (Days) |
|---|---|---|---|---|
| 5 (Invention) | 0.7 | H-1 | 3 | 5 |
| 6 (Invention) | 0.7 | H-2 | 4 | 6 |
| 7 (Comp. Ex.) | 0.4 | H-1 | 6 | 7 |
| 8 (Comp. Ex.) | 0.4 | H-2 | 7 | 8 |

It is clear from the above results that the samples of the present invention required less time to stabilize after coating.

EXAMPLE 3

Multi-layer color Photosensitive Materials 9 of the present invention and Comparative Sample 10 were prepared by the lamination coating of each of the layers having the composition indicated below, on the two types of supports as prepared in section (2-1) of Example 1.

Composition of the Photosensitive Layer

The coated weights are shown in units of grams of silver per square meter in the case of silver halides and colloidal silver, in units of grams per square meter in the case of couplers, additives and gelatin and in units of mols per mol of silver halide within the same layer in the case of sensitizing dyes. Moreover, the code used for the additives has the significance indicated below. However, in cases where an additive has more than one effect, it is coded as having just one of the multiple effects.

UV: Ultraviolet absorber, Solv: High boiling point organic solvent, ExF: Dye, ExS: Sensitizing dye, ExC: Cyan coupler, ExM: Magenta coupler, ExY: Yellow coupler, Cpd: Additive.

First Layer: Anti-halation Layer
- Black colloidal silver: 0.15
- Gelatin: 2.9
- UV-1: 0.03
- UV-2: 0.06
- UV-3: 0.07
- Solv-2: 0.08
- ExF-1: 0.01
- ExF-2: 0.01

Second Layer: Low Speed Red-Sensitive Emulsion Layer
- Silver iodobromide emulsion (4 mol% AgI, uniform AgI type, corresponding sphere diameter 0.4 μm, variation coefficient of corresponding sphere diameter 37%, plate like grains, diameter/thickness ratio 3.0): As silver 0.4
- Gelatin: 0.8
- ExS-1: $2.3\times10^{-4}$
- ExS-2: $1.4\times10^{-4}$
- ExS-5: $2.3\times10^{-4}$
- ExS-7: $8.0\times10^{-6}$
- ExC-1: 0.17
- ExC-2: 0.03
- ExC-3: 0.13

Third layer: Medium Speed Red-Sensitive Emulsion Layer
- Silver iodobromide emulsion (6 mol%, AgI, high internal AgI type of core/shell ratio 2:1, corresponding sphere diameter 0.65 μm, variation coefficient of corresponding sphere diameter 25%, plate like grains, diameter/thickness ratio 2.0): As silver 0.65
- Silver iodobromide emulsion (4 mol% AgI, uniform AgI type, corresponding sphere diameter 0.4 μm, variation coefficient of corresponding sphere diameter 37%, plate like grains, diameter/thickness ratio 3.0): As silver 0.1
- Gelatin: 1.0
- ExS-1: $2\times10^{-4}$
- ExS-2: $1.2\times10^{-4}$
- ExS-5: $2\times10^{-4}$
- ExS-7: $7\times10^{-6}$
- ExC-1: 0.31
- ExC-2: 0.01
- ExC-3: 0.06

Fourth Layer: High Speed Red-Sensitive Emulsion Layer

Silver iodobromide emulsion (6 mol% AgI, high internal AgI type of core/shell ratio 2:1, corresponding sphere diameter 0.7 μm, variation coefficient of corresponding sphere diameter 25%, plate like grains, diameter/thickness ratio 2.5): As silver 0.9
Gelatin: 0.8
ExS-1: $1.6\times10^{-4}$
ExS-2: $1.6\times10^{-4}$
ExS-5: $1.6\times10^{-4}$
ExS-7: $6\times10^{-4}$
ExC-1: 0.07
ExC-4: 0.05
Solv-1: 0.07
Solv-2: 0.20
Cpd-7: $4.6\times10^{-4}$ Fifth Layer: Intermediate Layer
Gelatin: 0.6
UV-4: 0.03
UV-5: 0.04
Cpd-1: 0.1
Poly(ethyl acrylate) latex: 0.08
Solv-1: 0.05

Sixth Layer: Low Speed Green-Sensitive Emulsion Layer
Silver iodobromide emulsion (4 mol% AgI, uniform AgI type, corresponding sphere diameter 0.4 μm, variation coefficient of corresponding sphere diameter 37%, plate like grains, diameter/thickness ratio 2.0): As silver 0.18
Gelatin: 0.4
ExS-3: $2\times10^{-4}$
ExS-4: $7\times10^{-4}$
ExS-5: $1\times10^{-4}$
ExM-5: 0.11
ExM-7: 0.03
ExY-8: 0.01
Solv-1: 0.09
Solv-4: 0.01

Seventh Layer: Medium Speed Green-Sensitive Emulsion Layer
Silver iodobromide emulsion (4 mol% AgI, high surface AgI type of core/shell ratio 1:1, corresponding sphere diameter 0.5 μm, variation coefficient of corresponding sphere diameter 20%, plate like grains, diameter/thickness ratio 4.0): As silver 0.27
Gelatin: 0.6
ExS-3: $2\times10^{-4}$
ExS-4: $7\times10^{-4}$
ExS-5: $1\times10^{-4}$
ExM-5: 0.17
ExM-7: 0.04
ExY-8: 0.02
Solv-1: 0.14
Solv-4: 0.02

Eighth Layer: High Speed Green-Sensitive Emulsion Layer
Silver iodobromide emulsion (8.7 mol% AgI, multilayer grains with silver ratio 3:4:2, AgI contents from the core of 24 mol%, 0 and 3 mol%, corresponding sphere diameter 0.7 μm, variation coefficient of corresponding sphere diameter 25%, plate like grains, diameter/thickness ratio 1.6): As silver 0.7
Gelatin: 0.8
ExS-4: $5.2\times10^{-4}$
ExS-5: $1\times10^{-4}$
ExS-8: $0.3\times10^{-4}$
ExM-5: 0.1
ExM-6: 0.03
ExY-8: 0.02
ExC-1: 0.02
ExC-4: 0.01
Solv-1: 0.25
Solv-2: 0.06
Solv-4: 0.01
Cpd-7: $1\times10^{-4}$ Ninth Layer: Intermediate Layer
Gelatin: 0.6
Cpd-1: 0.04
Poly(ethyl acrylate) latex: 0.12
Solv-1: 0.02

Tenth Layer: Donor Layer for the Lamination Effect for the Red-Sensitive Layer
Silver iodobromide emulsion (6 mol%, AgI, high internal AgI type of core/shell ratio 2:1, corresponding sphere diameter 0.7 μm, variation coefficient of corresponding sphere diameter 25%, plate like grains, diameter/thickness ratio 2.0): As silver 0.68
Silver iodobromide emulsion (4 mol% AgI, uniform AgI type, corresponding sphere diameter 0.4 μm, variation coefficient of corresponding sphere diameter 37%, plate like grains, diameter/thickness ratio 3.0): As silver 0.19
Gelatin: 1.0
ExS-3: $6\times10^{-4}$
SxM-10: 0.19
Solv-1: 0.20

Eleventh Layer: Yellow Filter
Yellow colloidal silver: 0.06
Gelatin: 0.8
Cpd-2: 0.13
Solv-1: 0.13
Cpd-1: 0.07
Cpd-6: 0.002
H-1: 0.13

Twelfth Layer: Low Speed Blue-Sensitive Emulsion Layer
Silver iodobromide emulsion (4.5 mol% AgI, uniform AgI type, corresponding sphere diameter 0.7 μm, variation coefficient of corresponding sphere diameter 15%, plate like grains, diameter/thickness ratio 7.0): As silver 0.3
Silver iodobromide emulsion (3 mol% AgI, uniform AgI type, corresponding sphere diameter 0.3 μm, variation coefficient of corresponding sphere diameter 30%, plate like grains, diameter/thickness ratio 7.0): As silver 0.15
Gelatin: 1.8
ExS-6: $9\times10^{-4}$
ExC-1: 0.06
ExC-4: 0.03
ExY-9: 0.14
ExY-11: 0.89
Solv-1: 0.42

Thirteenth Layer: Intermediate Layer
Gelatin: 0.7
ExY-12: 0.20
Solv-1: 0.34

Fourteenth Layer: High Speed Blue-Sensitive Emulsion Layer
Silver iodobromide emulsion (10 mol% AgI, high internal AgI type, corresponding sphere diameter 1.0 μm, variation coefficient of corresponding sphere diameter 25%, plate like grains, diameter/thickness ratio 2.0): As silver 0.5
Gelatin: 0.5

ExS-6: $1\times10^{-4}$
ExY-9: 0.01
ExY-11: 0.20
ExC-1: 0.02
Solv-1: 0.10

Fifteenth Layer: First Protective Layer

Fine-grained silver iodobromide emulsion (2 mol% AgI, uniform AgI type, corresponding sphere diameter 0.07 μm): As silver 0.12
Gelatin: 0.9
UV-4: 0.11
UV-5: 0.16
Solv-5: 0.02
H-1: 0.13
Cpd-5: 0.10
Poly(ethyl acrylate) latex: 0.09

Sixteenth Layer: Second Protective Layer

Fine-grained silver iodobromide emulsion (2 mol% AgI, uniform AgI type, corresponding sphere diameter 0.07 μm): As silver 0.36
Gelatin: 0.55
Poly(ethyl methacrylate) particles (diameter 1.5 μm): 0.2

The film hardening agent H-3 was added in an amounts of 2.5 wt% with respect to the total amount of gelatin coated.

As well as the components indicated above, emulsion stabilizer Cpd-3 (0.07 g/m$^2$) and surfactant Cpd-4 (0.03 g/m$^2$) were added to each layer as coating promotors.

UV-1

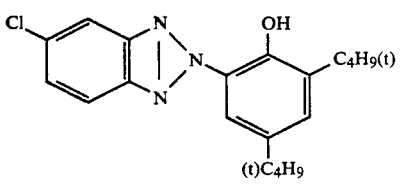

-continued

UV-2

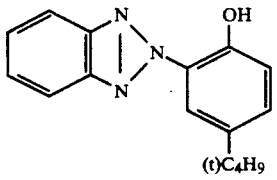

UV-3

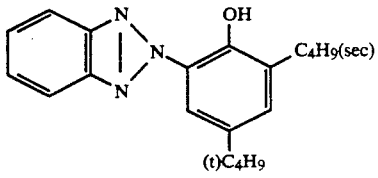

UV-4

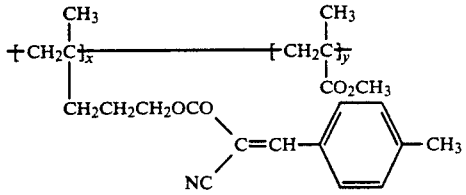

x:y = 70:30 (wt %)

UV-5

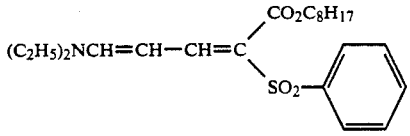

Solv-1 Tricresyl phosphate
Solv-2 Dibutyl phthalate

Tricresyl phosphate — Solv-1

Dibutyl phthalate — Solv-2

Solv-4

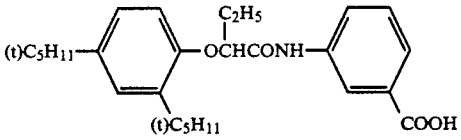

Trihexyl phosphate — Solv-5

ExF-1

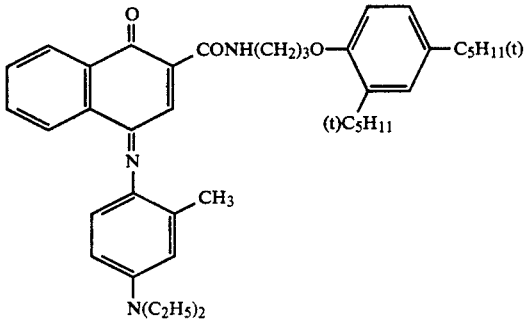

-continued
ExF-2
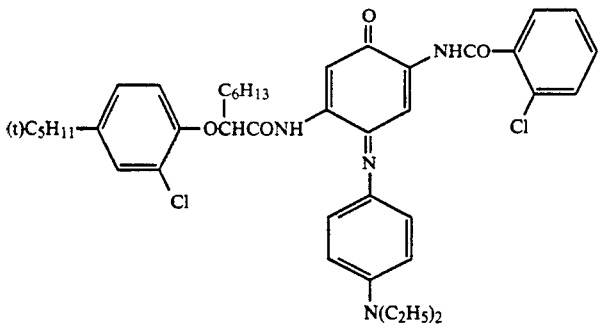
ExS-1
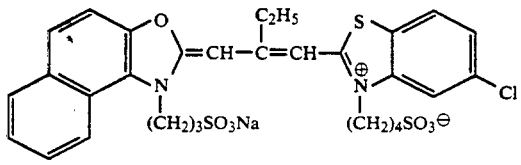
ExS-2
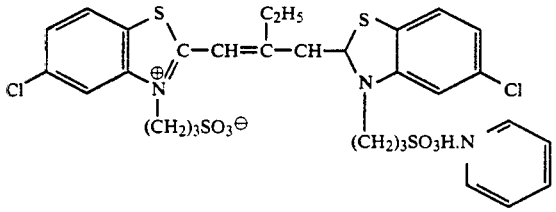
ExS-3
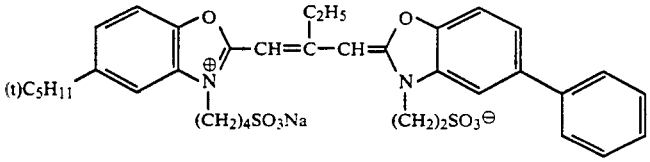
ExS-4
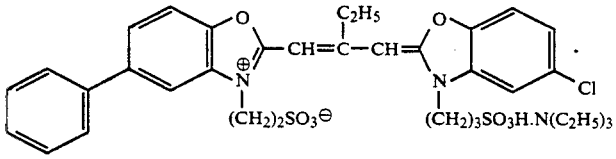
ExS-5
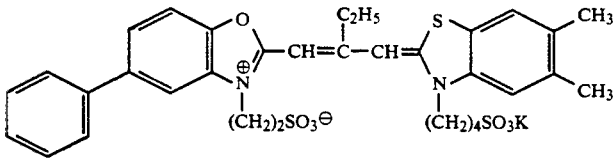
ExS-6
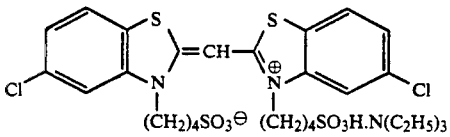
ExS-7
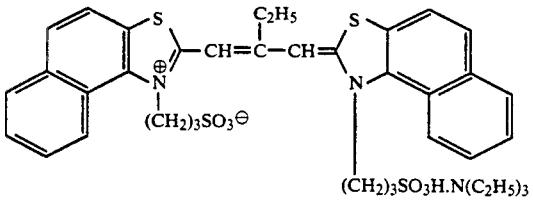

-continued
ExS-8
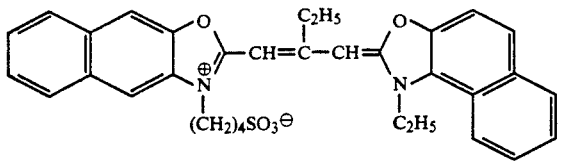
ExC-1
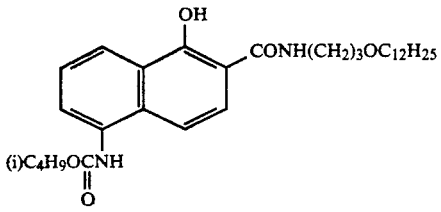
ExC-2
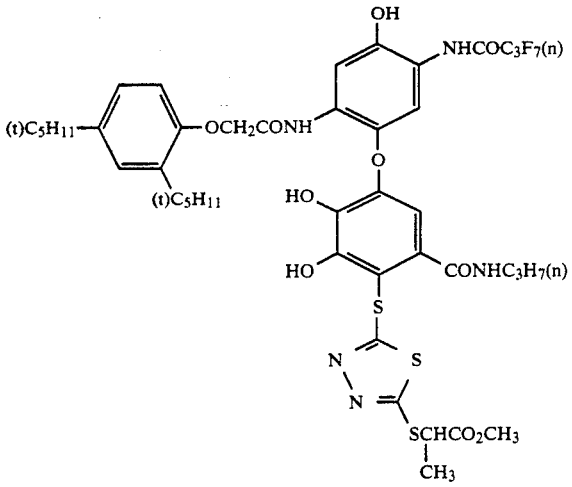
ExC-3
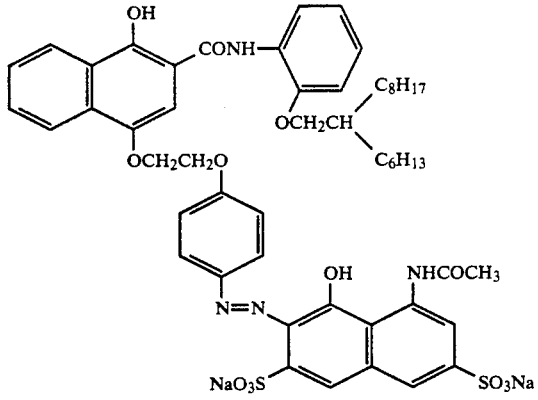
ExC-4
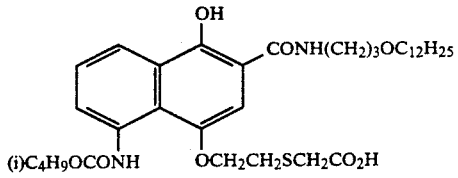

-continued
ExM-5
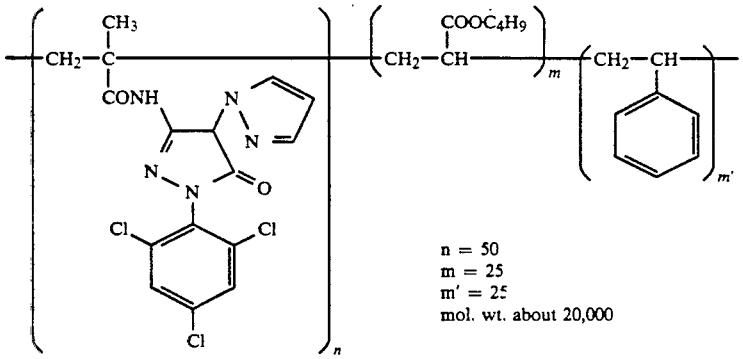
ExM-6
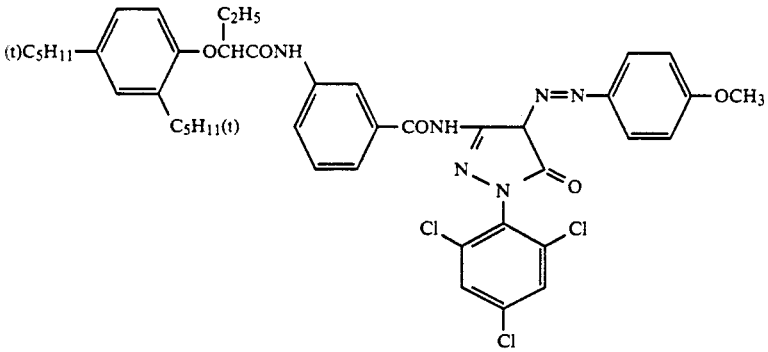
ExM-7
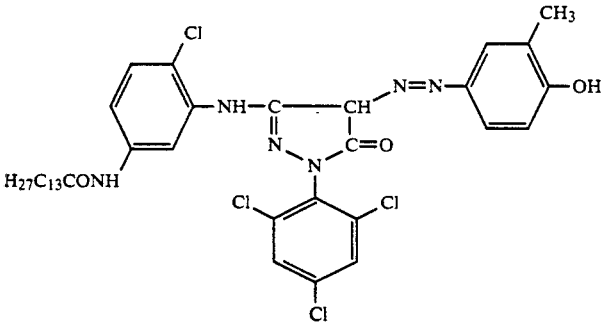
ExM-10
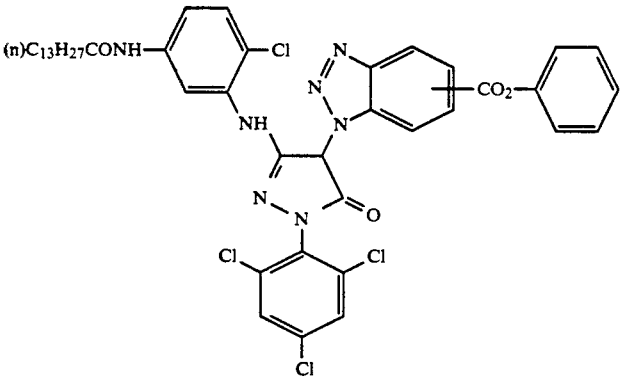

-continued
ExY-8
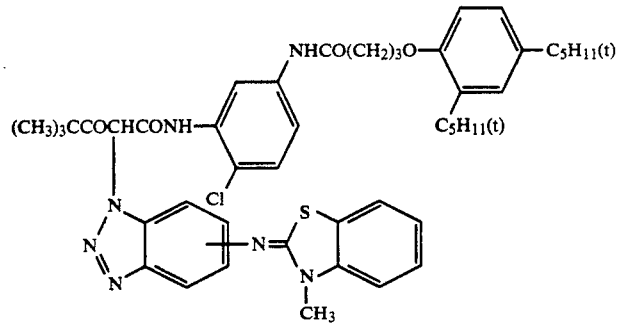
ExY-9
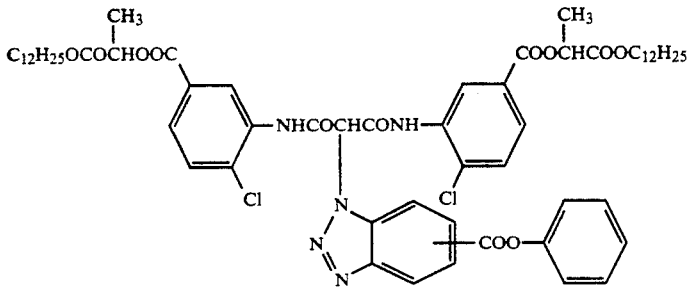
ExY-11
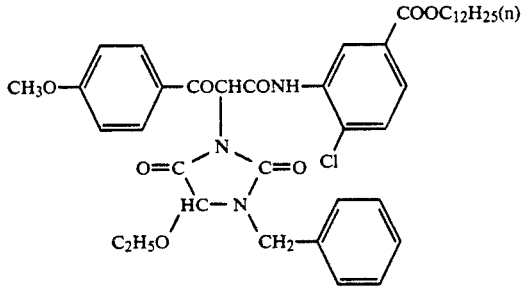
ExY-12
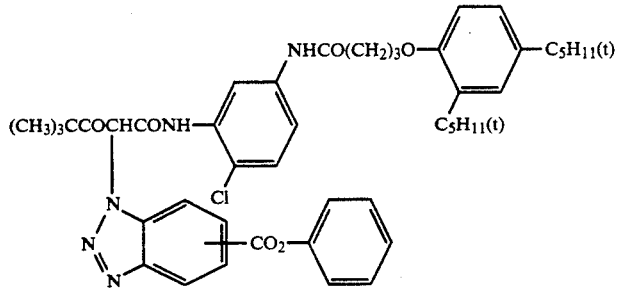
Cpd-7
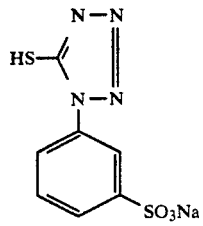

-continued

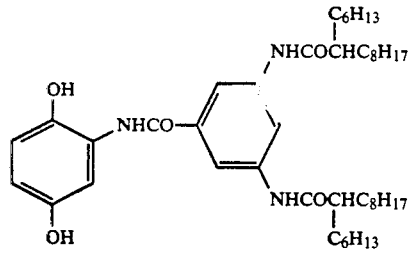

Cpd-1

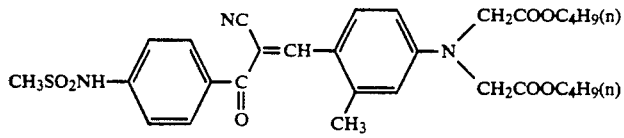

Cpd-2

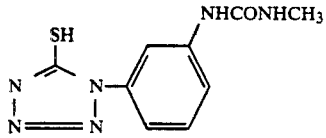

Cpd-6

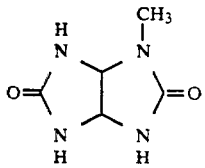

Cpd-5

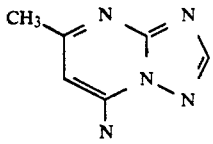

Cpd-3

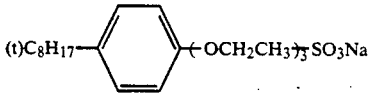

Cpd-4

Tests were carried out in the same way as in Example 1, except that the roll samples were stored at 32° C. The results are shown in Table 3.

TABLE 3

| Photosensitive Material | Water Content of Support (%) | Film Hardening Agent | Time Required for Degree of Swelling to Become Constant (Days) | Time Required for Photographic Performance to Become Constant (Days) |
|---|---|---|---|---|
| 9 (Invention) | 0.7 | H-3 | 7 | 8 |
| 10 (Comp. Ex.) | 0.4 | H-3 | 13 | 14 |

It is clear from the above results that the samples of the present invention required less time to stabilize after coating.

EXAMPLE 4

Photosensitive Materials 11 to 14 were prepared in the same manner as in Example 1, except that the moisture levels were adjusted in an environment of 35° C. and 70% RH in the final drying process.

The thus prepared photosensitive materials were subjected to the same tests, and the results are shown in Table 4.

TABLE 4

| Photosensitive Material | Water Content of Support (%) | Film Hardening Agent | Time Required for Degree of Swelling to Become Constant (Days) | Time Required for Photographic Performance to Become Constant (Days) |
|---|---|---|---|---|
| 11 (Invention) | 0.7 | H-5 | 4 | 6 |
| 12 (Comp. Ex.) | 0.4 | H-5 | 10 | 13 |
| 13 (Comp. Ex.) | 0.7 | H-A | 15 | 16 |

TABLE 4-continued

| Photosensitive Material | Water Content of Support (%) | Film Hardening Agent | Time Required for Degree of Swelling to Become Constant (Days) | Time Required for Photographic Performance to Become Constant (Days) |
|---|---|---|---|---|
| 14 (Comp. Ex.) | 0.4 | H-A | 28 | 29 |

It is seen from the above results that the effect of the present invention due to combination of the support and the hardening agent becomes more remarkable when the temperature was adjusted to 35° C. in the final drying process.

EXAMPLE 5

The same procedures as in Examples 1 to 4 were repeated except that the development processing conditions and the compositions of the processing baths were changed as indicated below. As a result, similar results to those of Examples 1 to 4 were obtained.

| | Temperature | Time |
|---|---|---|
| Color Development | 38° C. | 3 minutes 15 seconds |
| Bleach | 38° C. | 6 minutes 30 seconds |
| Water Wash | 25° C. | 2 minutes 10 seconds |
| Fix | 38° C. | 4 minutes 20 seconds |
| Water Wash | 25° C. | 3 minutes 15 seconds |
| Stabilization | 38° C. | 1 minute 05 seconds |

Color Development Bath
- Diethylenetriaminepentaacetic acid: 1.0 gram
- 1-Hydroxyethylidene-1,1-diphosphonic acid: 3.0 grams
- Sodium sulfite: 4.0 grams
- Potassium carbonate: 30.0 grams
- Potassium bromide: 1.4 grams
- Hydroxylamine sulfate: 1.5 mg
- 4-(N-Ethyl-N-β-hydroxyethylamino)-2-methylaniline sulfate: 4 5 grams
- Water: to make 1 0 liter
- pH:10.05

Bleach Bath
- Ammonium ethylenediaminetetraacetato ferrate: 100.0 grams
- Disodium ethylenediaminetetraacetate: 10.0 grams
- Ammonium bromide: 150 0 grams
- Ammonium nitrate: 10 0 grams
- Water: to make 1.0 liter
- pH: 6.0

Fixer Bath
- Disodium ethylenediaminetetraacetate: 0.5 gram
- Sodium sulfite: 7.0 grams
- Aqueous ammonium thiosulfate solution (700 g/l): 170.0 ml
- Sodium bisulfite: 5.0 grams
- Water: to make 1.0 liter
- pH: 6.7

Stabilizer Bath
- Formalin(37 wt%): 2.0 ml
- Polyoxyethylene-p-monononylphenyl ether (average degree of polymerization 10): 0.3 gram
- Water: to make 1.0 liter While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a film support having thereon at least one hydrophilic colloid layer, at least one layer of which is a photosensitive silver halide emulsion layer and at least one layer of which contains gelatin as a binder, wherein the film support is a polyester film having a water uptake of at least 0.5 wt%, said water uptake being determined by equilibrating the polyester film for 3 hours at 23° C. and 30% RH, then immersing the film in distilled water at 23° C. for 15 minutes and then measuring the water content using a micro-moisture meter at a drying temperature of 150° C., and the silver halide photographic material contains a vinylsulfone based film hardening agent in at least one gelatin-containing layer in a total amount of from 0.01 to 20 wt% with respect to the total amount of gelatin on a dry basis, present in the silver halide photographic material, said vinylsulfone based film hardening agent is a compound represented by the general formula (I):

$$X^1\text{-}SO_2\text{-}L\text{-}SO_2\text{-}X^2 \quad (I)$$

wherein $X^1$ and $X^2$ represent $-CH{=}CH_2$ or $-CH_2CH_2-Y$ groups, and $X^1$ and $X^2$ may be the same or different; Y represents a group which can be substituted by a nucleophilic reagent having a nucleophilic group, or which can be eliminated in the form of HY by a base; and L is a divalent linking group which may be substituted.

2. A silver halide photographic material as in claim 1, wherein the polyester film is a copolymer containing ethylene terephthalate units as a main component.

3. A silver halide photographic material as in claim 2, wherein the copolymer polyester film further contains units derived from an aromatic dicarboxylic acid having a metal sulfonate group.

4. A silver halide photographic material as in claim 3, wherein the aromatic dicarboxylic acid having a metal sulfonate group is selected from the group consisting of 5-sodiumsulfoisophthalic acid, 2-sodiumsulfoterephthalic acid, 4-sodiumsulfophthalic acid, 4-sodiumsulfo-2,6-naphthalenedicarboxylic acid and compounds in which the sodium is replaced, by potassium or lithium.

5. A silver halide photographic material as in claim 2, wherein the copolymer polyester film further contains units derived from aliphatic dicarboxylic acid having from 4 to 20 carbon atoms.

6. A silver halide photographic material as in claim 5, wherein the copolymer polyester film further contains one or more segments derived from a poly(alkylene glycol) of molecular weight of from 600 to 20,000.

7. A silver halide photographic material as in claim 2, wherein the copolymer polyester film further contains one or more segments derived from a poly(alkylene glycol) of molecular weight of from 600 to 20,000.

8. A silver halide photographic material as in claim 7, wherein the one or more segments derived from the poly (alkylene glycol) constitute less than 10 wt% of the copolymer polyester film.

9. A silver halide photographic material as in claim 3, wherein the proportion of units derived from an aromatic dicarboxylic acid having a metal sulfonate group is from 2 to 15 mol% with respect to the ethylene terephthalate units contained in the copolymer polyester film.

10. A silver halide photographic material as in claim 5, wherein the proportion of units derived from an aliphatic dicarboxylic acid is from 3 to 25 mol% with respect to the ethylene terephthalate units contained in the copolymer polyester film.

11. A silver halide photographic material as in claim 1, wherein said at least one gelatin-containing layer further contains a hardening agent other than a vinylsulfone based hardening agent.

12. A silver halide photographic material as in claim 1, wherein the total amount of hardening agent constitutes from 0.01 to 20 wt% with respect to the total amount of gelatin, on a dry basis, present in the silver halide photographic material.

13. A silver halide photographic material as in claim 12, wherein the vinylsulfone film hardening agent constitutes at least 50 mol% of the total amount of hardening agent.

14. A silver halide photographic material as in claim 1, wherein the polyester film has a water content of from 0.6 to 4.0 wt%.

* * * * *